US006293642B1

(12) United States Patent
Sano

(10) Patent No.: US 6,293,642 B1
(45) **Date of Patent: *Sep. 25, 2001**

(54) INK JET PRINTER OUTPUTTING HIGH QUALITY IMAGE AND METHOD OF USING SAME

(75) Inventor: Eiichi Sano, Itami (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/062,466

(22) Filed: Apr. 20, 1998

(30) Foreign Application Priority Data

Apr. 23, 1997 (JP) ..... 9-106121

(51) Int. Cl.[7] ..... B41J 2/205
(52) U.S. Cl. ..... 347/15; 347/10; 347/68
(58) Field of Search ..... 347/15, 10, 68

(56) References Cited

U.S. PATENT DOCUMENTS

| | | | | |
|---|---|---|---|---|
| 4,115,789 | | 9/1978 | Fischbeck | 347/70 |
| 4,222,060 | * | 9/1980 | Sato et al. | 347/9 |
| 4,752,788 | | 6/1988 | Yasuhara et al. | 347/68 |
| 5,270,740 | | 12/1993 | Naruse et al. | 347/72 |
| 5,373,314 | | 12/1994 | Everett et al. | 347/71 |
| 5,446,485 | | 8/1995 | Usui et al. | 347/72 |
| 5,461,403 | * | 10/1995 | Wallace | 347/10 |
| 5,477,249 | | 12/1995 | Hotomi | 347/48 |
| 5,477,253 | | 12/1995 | Hotomi et al. | 347/71 |
| 5,587,727 | * | 12/1996 | Sugahara et al. | 347/12 |
| 5,677,717 | | 10/1997 | Ohashi | 347/69 |
| 5,923,345 | * | 7/1999 | Imai | 347/11 |
| 5,933,168 | * | 8/1999 | Sakai | 347/70 |
| 6,024,438 | * | 2/2000 | Koike et al. | 347/43 |
| 6,029,896 | * | 2/2000 | Self et al. | 347/11 |
| 6,126,263 | * | 10/2000 | Hotomi et al. | 347/15 |
| 6,154,228 | * | 11/2000 | Okuda et al. | 347/15 |

FOREIGN PATENT DOCUMENTS

| | | | |
|---|---|---|---|
| 3-243358 | 10/1991 | (JP) | 347/72 |
| 4-353455 | 12/1992 | (JP) | 347/69 |
| 5-104725 | 4/1993 | (JP) | 347/48 |
| 5-107932 | 4/1993 | (JP) | 399/249 |
| 5-269984 | 10/1993 | (JP) | 347/44 |

OTHER PUBLICATIONS

Serial No. 09/261,076.
Serial No. 09/019,253.

* cited by examiner

*Primary Examiner*—John Barlow
*Assistant Examiner*—Blaine Mouttet
(74) *Attorney, Agent, or Firm*—Burns, Doane, Swecker & Mathis, LLP

(57) ABSTRACT

An ink jet printer is adapted to drive a piezoelectric element by applying pulse voltage having waveforms of A1–A8 based on image data, fly ink drops respectively having sizes corresponding to waveforms A1–A8 of the pulse voltage, and record an image on a recording sheet. In the ink jet printer, a rise rate of pulse voltage having waveforms A1–A3 corresponding to ink drops of relatively small sizes is set such that the rise rate is high compared with that of pulse voltage having waveforms A4–A8.

19 Claims, 26 Drawing Sheets

3

3

PRIOR ART

PRIOR ART

PRIOR ART

PRIOR ART

PRIOR ART

PRIOR ART

PRIOR ART

PRIOR ART

PRIOR ART

PRIOR ART

PRIOR ART

INK JET PRINTER OUTPUTTING HIGH QUALITY IMAGE AND METHOD OF USING SAME

BACKGROUND OF THE INVENTION

1. Field of the Invention

The present invention relates to an ink jet printer, and particularly to an ink jet printer which applies pulse voltage based on image data to drive a piezoelectric element.

2. Description of the Related Art

This application is based on application No. 9-106121 filed in Japan, the contents of which is hereby incorporated by reference.

An ink jet printer using a piezoelectric element in its head is known. Pulse voltage according to image information is applied to the piezoelectric element of the head of such an ink jet printer. Deformation of the piezoelectric element caused by the application of the pulse voltage pressurizes ink in a prescribed container (ink channel), and ink drops are emitted from a nozzle provided to the ink channel toward a recording sheet. The ink drops fly to record an image on the recording sheet.

A demand for a printer adapted for full-color printing is growing due to an improving network environment and prevalence of such a device as a digital camera. In order to satisfy such a demand, a technique for enhancing the quality of a printed image by using such an ink jet printer is developing. A technique of increasing levels of gradation of an image is required for outputting a high quality image by the ink jet printer.

As a method for reproducing gradation by an ink jet printer, a method of changing an area of a dot produced by impact of a single ink drop on a recording sheet is known. By this method, a degree of deformation of a piezoelectric element in a head is controlled, that is, the amplitude (maximum value) of pulse voltage applied to the piezoelectric element is changed to fly ink drops of different volumes from the same ink channel and the same nozzle.

A problem of the method of changing only the maximum value of the pulse voltage is that a dynamic range (a range of a diameter of a dot which can be output by the same nozzle) is limited by the material property of ink such as the mass and viscosity of the ink, a diameter of a nozzle, a structure of an ink channel, and the like. Therefore, it is very difficult to increase the dynamic range to improve a quality of an image. Further, increase of frequency that drives a piezoelectric element is highly difficult due to such limitation.

SUMMARY OF THE INVENTION

An object of the present invention is to provide an ink jet printer by which a dynamic range is increased to improve a quality of an image. Another object of the present invention is to provide an ink jet printer by which frequency that drives a piezoelectric element can be increased while a quality of an image is maintained.

According to an aspect of the invention for achieving the object above, an ink jet printer is provided that records an image on a recording medium by applying pulse voltage having a waveform of a prescribed shape to a piezoelectric element for driving the element and causing ink drops of different sizes to fly. The ink jet printer includes a voltage controller varying a degree of change of the pulse voltage while the pulse voltage is rising, according to a size of an ink drop to be flown.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An ink jet printer according to an embodiment of the present invention is hereinafter described referring to figures.

Figure 1:
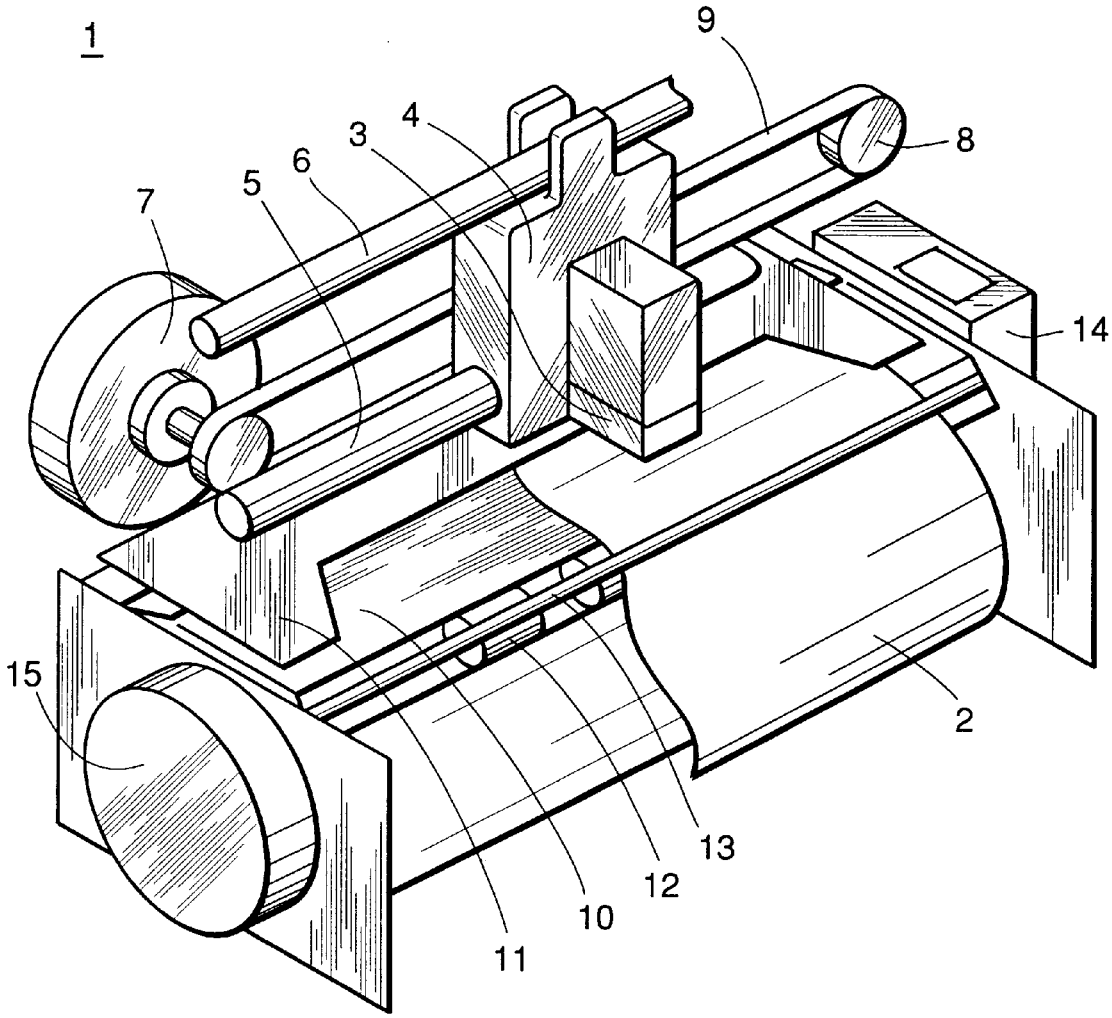
FIG. 1 is a perspective view showing a schematic structure of an ink jet printer 1 according to a first embodiment of the invention.

FIG. 1 is a perspective view showing a schematic structure of an ink jet printer 1 according to a first embodiment of the invention.

Ink jet printer 1 includes a head 3 which is a print head of an ink jet system for printing on a recording sheet 2 which is any of recording media such as a paper and an OHP sheet. The printer further includes a carriage 4 holding head 3, rock axes 5 and 6 for reciprocating carriage 4 in parallel with a surface of recording sheet 2 on which recording is made, a drive motor 7 driving carriage 4 to reciprocate along rock axes 5 and 6, an idle pulley 8 for changing rotation of drive motor 7 to reciprocation of carriage 4, and a timing belt 9.

Ink jet printer 1 still further includes a platen 10 which combines a platen with a guide plate guiding recording sheet 2 along a transport path, a paper press plate 11 for preventing lifting of recording sheet 2 between the sheet and platen 10, a discharge roller 12 for discharging recording sheet 2, an urge roller 13, a recover system 14 cleaning a surface of a nozzle of head 3 that emits ink for recovering any poor condition of emission of ink to a preferable condition, and a paper transfer knob 15 for manual transport of recording sheet 2.

Recording sheet 2 is transported to a recording portion where head 3 and platen 10 are opposite to each other, by manual feeding or a feeding unit such as a cut sheet feeder. At this time, an amount of rotation of a paper transfer roller (not shown) is controlled to control transport of the recording sheet to the recording portion.

A piezoelectric element is used in head 3. Voltage is applied to the piezoelectric element to cause deformation of the element. The deformation changes the capacity of a channel filled with ink. The change of the capacity causes ink to be emitted from a nozzle provided for the channel, and a recording is made on recording sheet 2.

Drive motor 7, idle pulley 8 and timing belt 9 allow carriage 4 to perform main scanning of recording sheet 2 transversely, and head 3 attached to carriage 4 records an image corresponding to one line. Every time recording of one line is completed, recording sheet 2 is longitudinally transported, subscanning of the sheet is carried out, and the next line is recorded.

Figure 2:
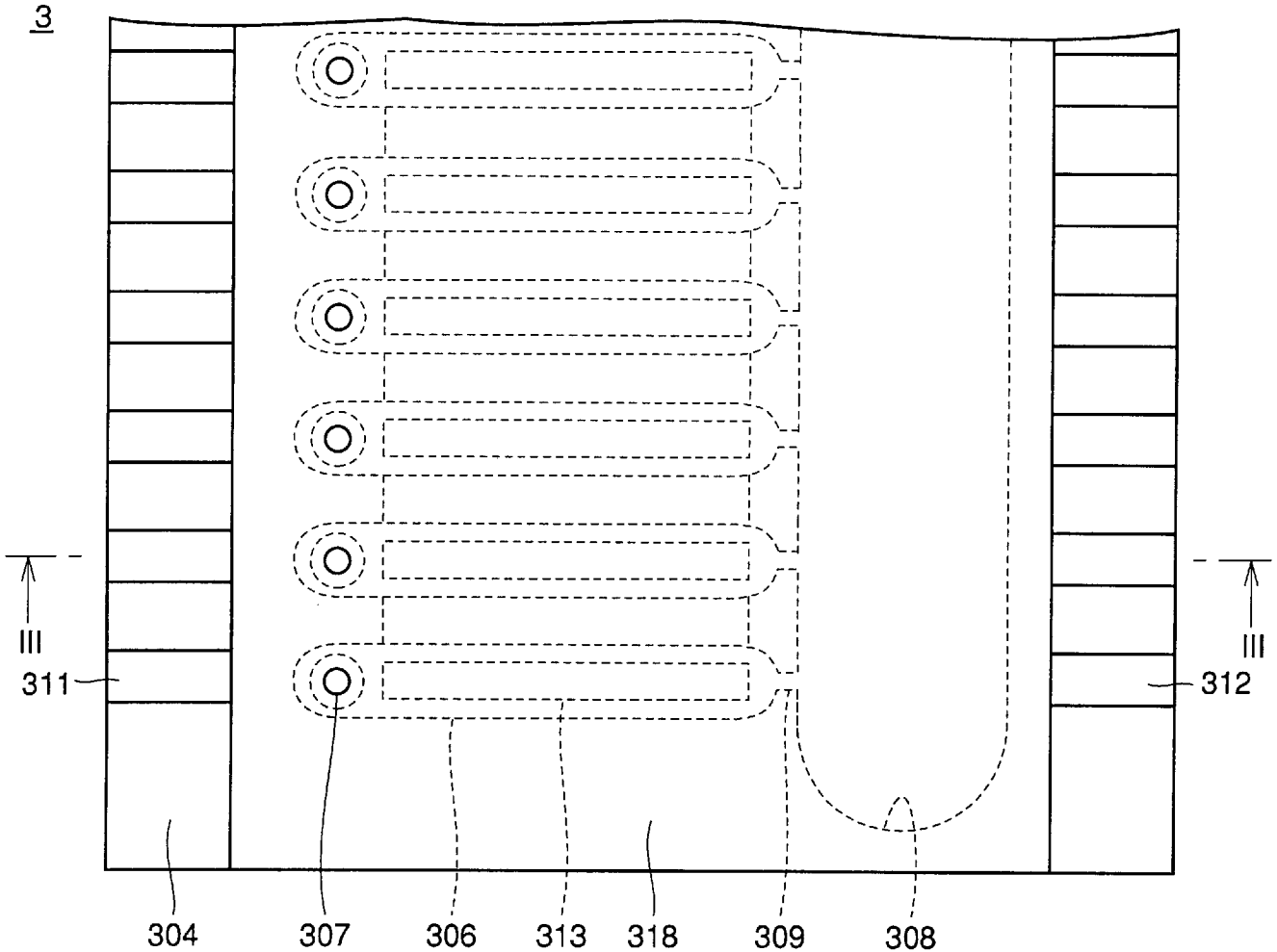
FIG. 2 is a plan view of a surface of a head 3 provided with a nozzle.
Figure 3:
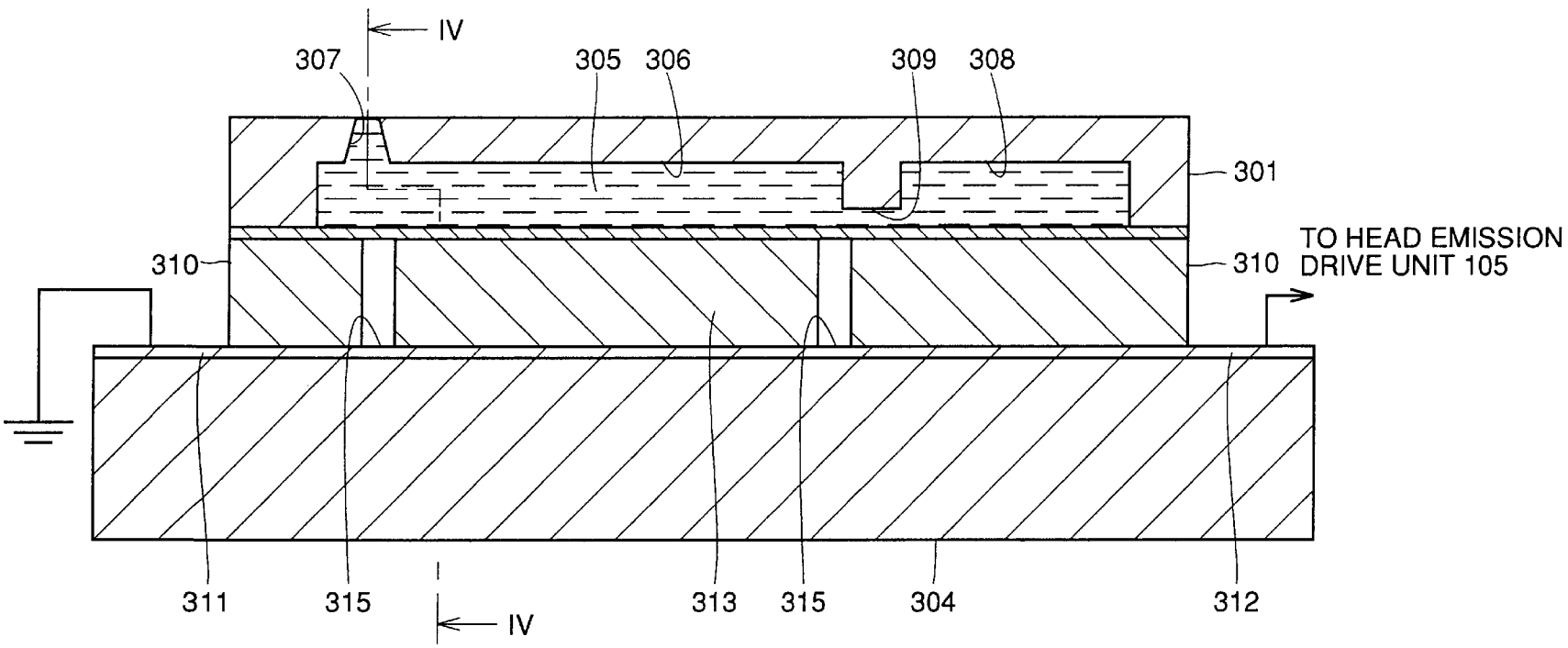
FIG. 3 is a cross sectional view along the line III—III of FIG. 2.
Figure 4:
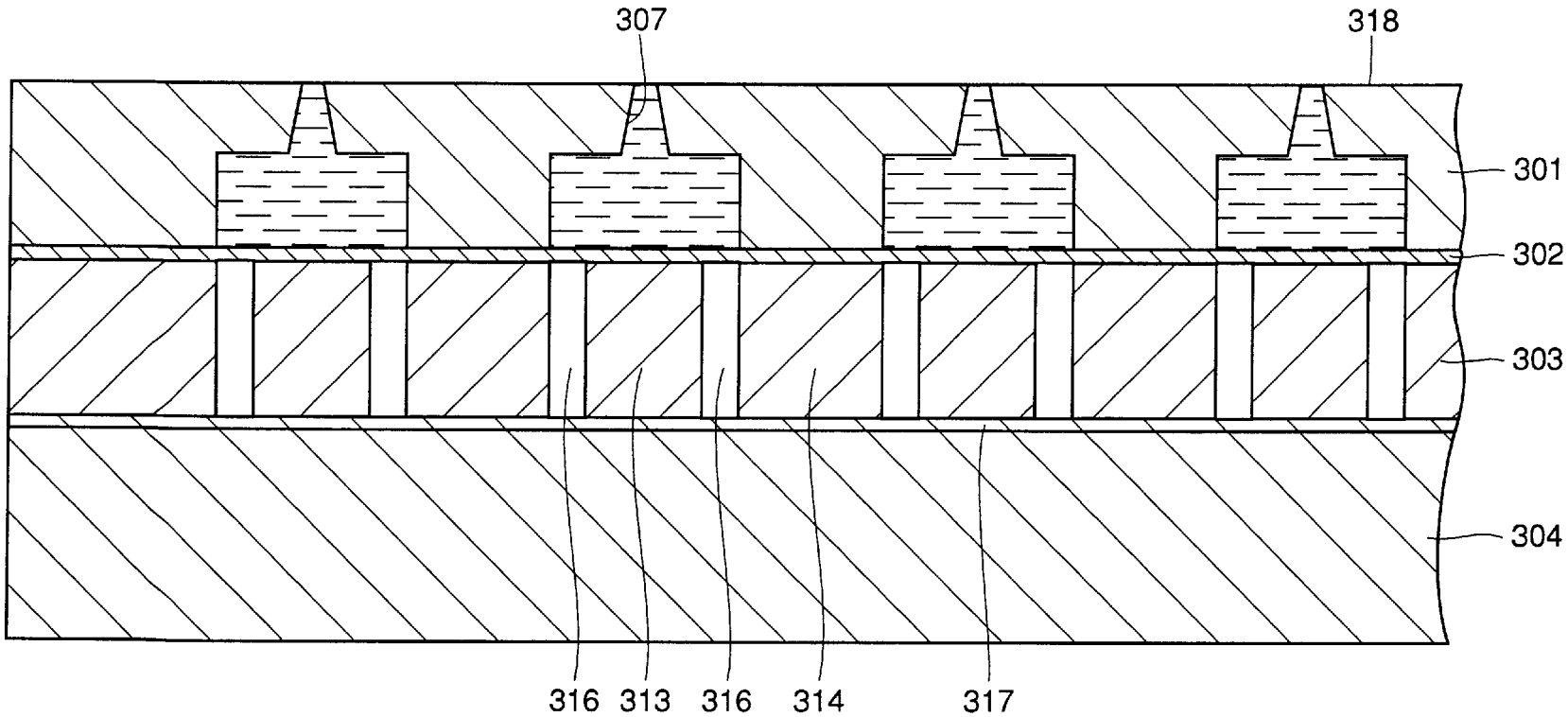
FIG. 4 is a cross sectional view along the line IV—IV of FIG. 3.

FIGS. 2–4 are provided for describing a structure of head 3. FIG. 2 is a plan view of a surface provided with a nozzle of head 3, FIG. 3 is a cross sectional view along the line III—III of FIG. 2, and FIG. 4 is a cross sectional view along the line IV—IV of FIG. 3.

A nozzle plate 301, a diaphragm 302, a vibration plate 303 and a base plate 304 are integrally layered on one another to form head 3.

Nozzle plate 301 is formed of metal, ceramic, glass, resin or the like, and provided with nozzle 307. A surface 318 of nozzle plate 301 has an ink-repellent layer. A thin film is used for diaphragm 302 fixed between nozzle plate 301 and vibration plate 303.

A plurality of ink channels 306 in which ink 305 is contained, and an ink inlet 309 which couples each ink channel 306 to an ink supply chamber 308 are formed between nozzle plate 301 and diaphragm 302. Ink supply chamber 308 is connected to an ink tank (not shown), and the ink within supply chamber 308 is supplied to ink channel 306.

Vibration plate 303 includes a plurality of piezoelectric elements 313 corresponding to respective ink channels 306. Vibration plate 303 is processed first by fixing vibration plate 303 to base plate 304 having a wiring portion 317 with insulating adhesive, and forming separate grooves 315 and 316 to divide vibration plate 303 by dicing. The vibration plate is divided to separate piezoelectric element 313 corresponding to each ink channel 306, a piezoelectric element column portion 314 located between adjacent piezoelectric elements 313, and a wall 310 surrounding those components.

Wiring portion 317 on base plate 304 includes a wiring portion on common electrode side 311 connected to the earth and connected commonly to all piezoelectric elements 313 in head 3, as well as a wiring portion on separate electrode side 312 separately connected to each piezoelectric element 313 in head 3. Common electrode side wiring portion 311 on base plate 304 is connected to a common electrode in piezoelectric element 313, and separate electrode side wiring portion 312 thereon is connected to a separate electrode in piezoelectric element 313.

An operation of head 3 having such a structure is controlled by a control unit of ink jet printer 1. A prescribed voltage which is a print signal is applied between a common electrode and a separate electrode provided in piezoelectric element 313, from a head emission drive unit 105 (see FIG. 5) of the control unit so that piezoelectric element 313 deforms in a direction to press diaphragm 302. The deformation of piezoelectric element 313 is conveyed to diaphragm 302 to pressurize ink 305 in ink channel 306, and ink drops are flown via nozzle 307 toward recording sheet 2 (see FIG. 1).

Figure 5:
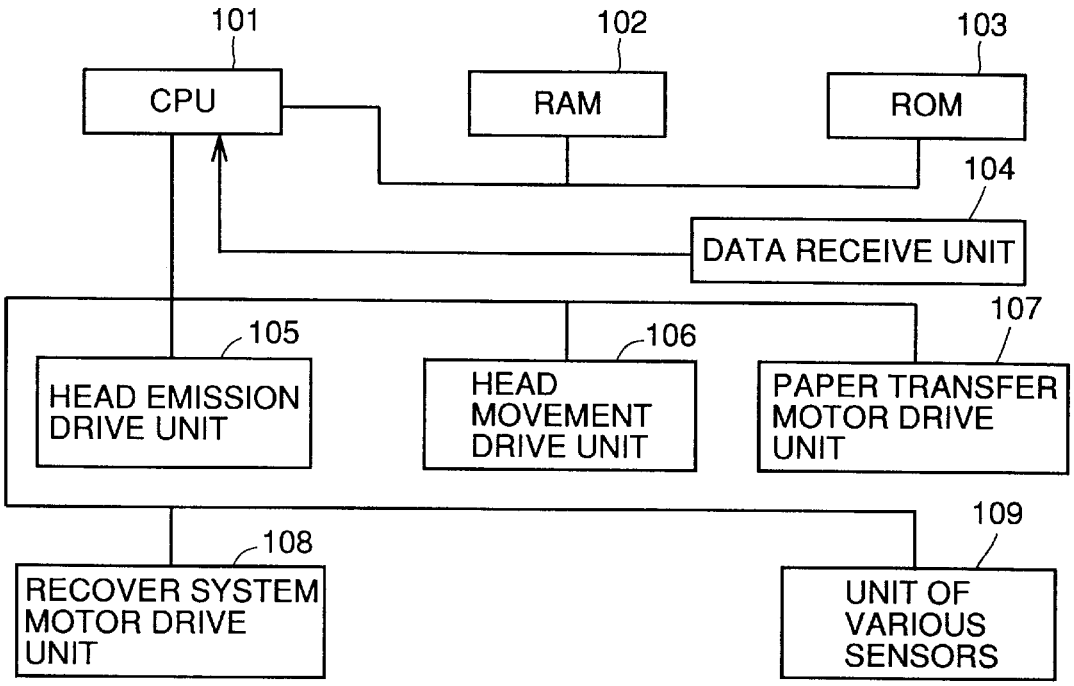
FIG. 5 is provided for describing a structure of a control unit of the ink jet printer 1.

FIG. 5 is provided for describing a structure of the control unit of ink jet printer 1.

A CPU 101 controlling the entire ink jet printer 1 executes a program stored in an ROM 103 using an RAM 102 storing image data as required. The program is formed of a portion for controlling head emission drive unit 105, a head movement drive unit 106, a paper transfer motor drive unit 107 and a unit of various sensors 109 in order to record an image on recording sheet 2 based on image data read from a data receive unit 104 connected to a host computer or the like and receiving image data to be recorded, and of a portion for controlling a recovery system motor drive unit 108 and unit of various sensors 109 and in order to recover the surface having the nozzle of the head 3 to a preferable state if necessary.

Based on the control by CPU 101, head emission drive unit 105 drives piezoelectric element 313 of head 3 by applying pulse voltage corresponding to the image data, head movement drive unit 106 drives drive motor 7 that moves carriage 4 holding head 3, and paper transfer motor drive unit 107 drives the paper transfer roller. Based on the control by CPU 101, recover system motor drive unit 108 drives a motor or the like necessary for recovering the nozzle surface of head 3 to a preferable state.

Figure 6:
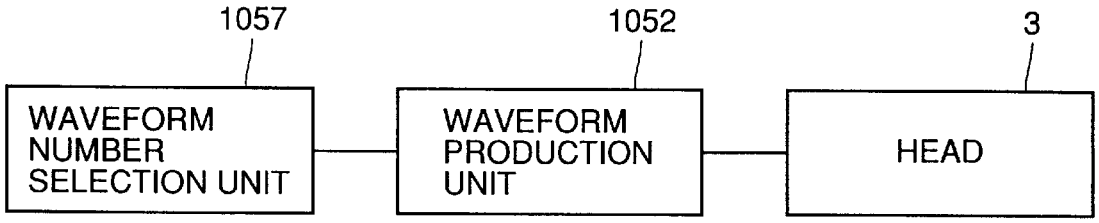
FIG. 6 is provided for generally describing how a head emission drive unit 105 is internally controlled.

FIG. 6 is provided for generally describing how head emission drive unit 105 is internally controlled.

In head emission drive unit 105, a waveform number for distinguishing a difference of the pulse voltage is selected by a waveform number selection unit 1057, according to image data referred to following an instruction from CPU 101. A waveform of the pulse voltage corresponding to the waveform number is generated by a waveform production unit 1052, with reference to data in ROM 103. The pulse voltage having the waveform thus generated is applied to piezoelectric element 313 in head 3.

Figure 7:
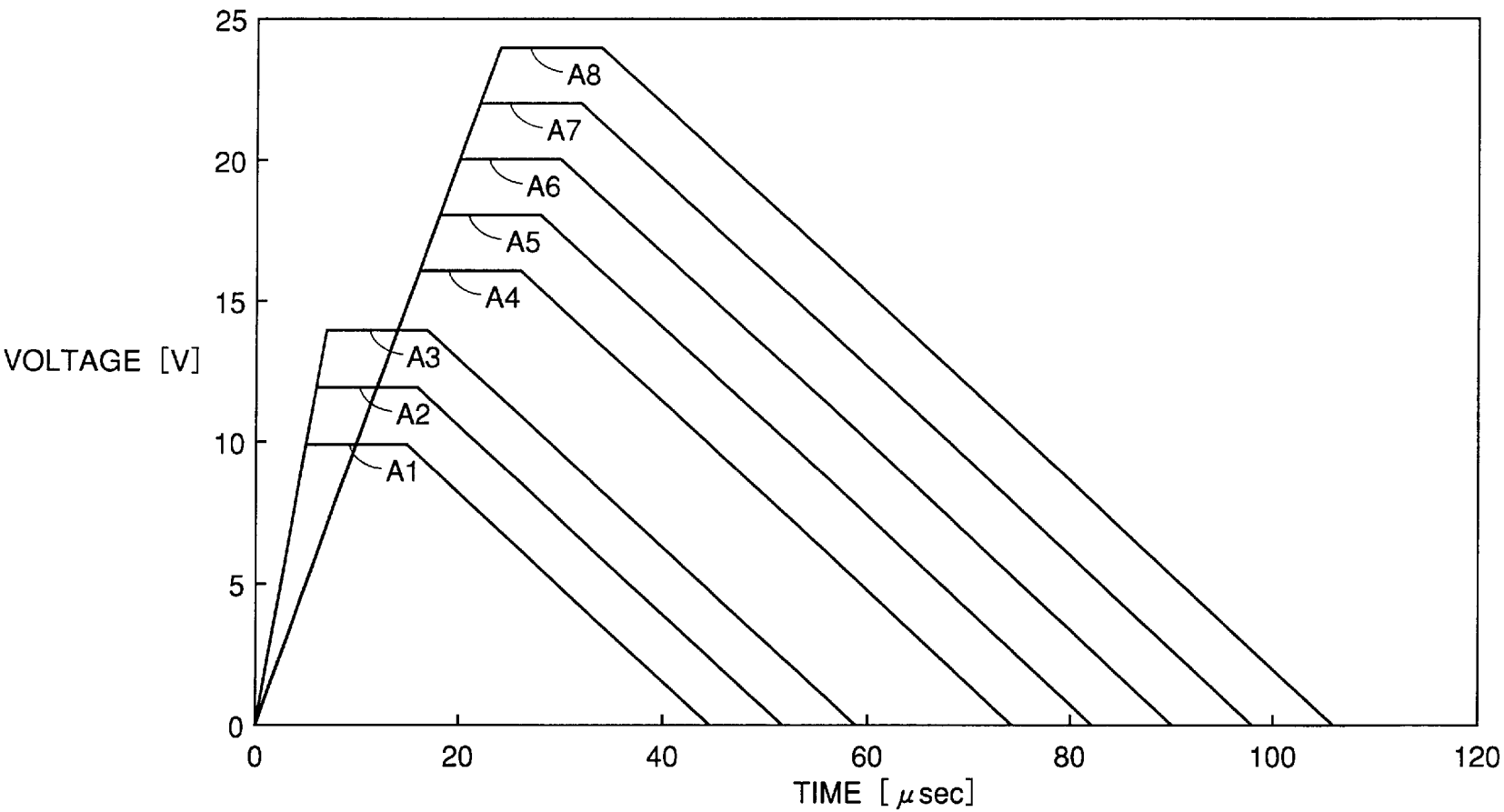
FIG. 7 shows a set of waveforms A1–A8 of pulse voltage applied to a piezoelectric element of an ink jet printer according to the first embodiment of the invention.
Figure 8:
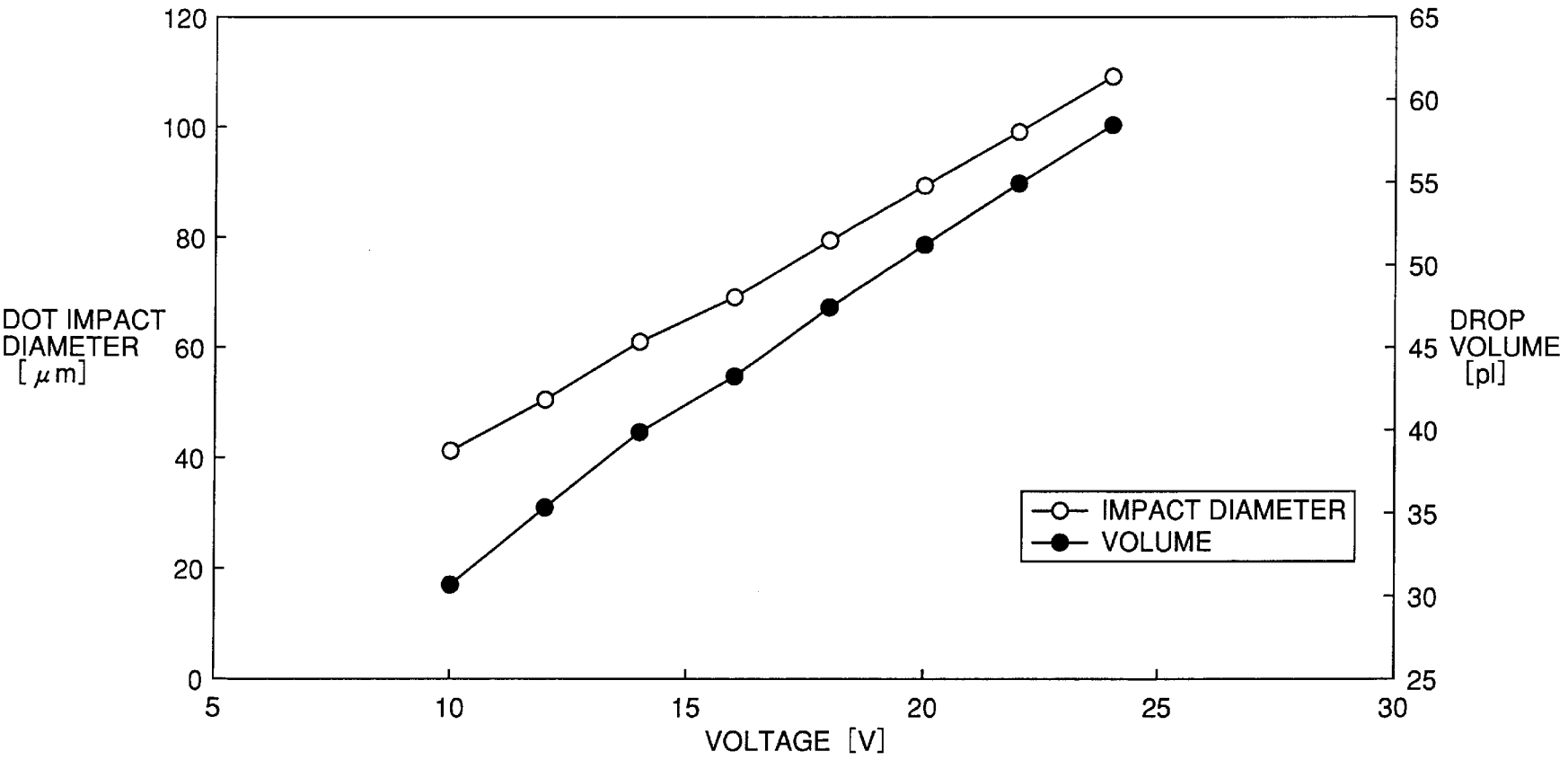
FIG. 8 shows the diameter of a dot produced by an ink drop flying and impacting on a medium (dot impact diameter), and the volume of the ink drop. The ink drop is flown by pulse voltage having waveforms A1–A8 shown in FIG. 7.
Figure 12:
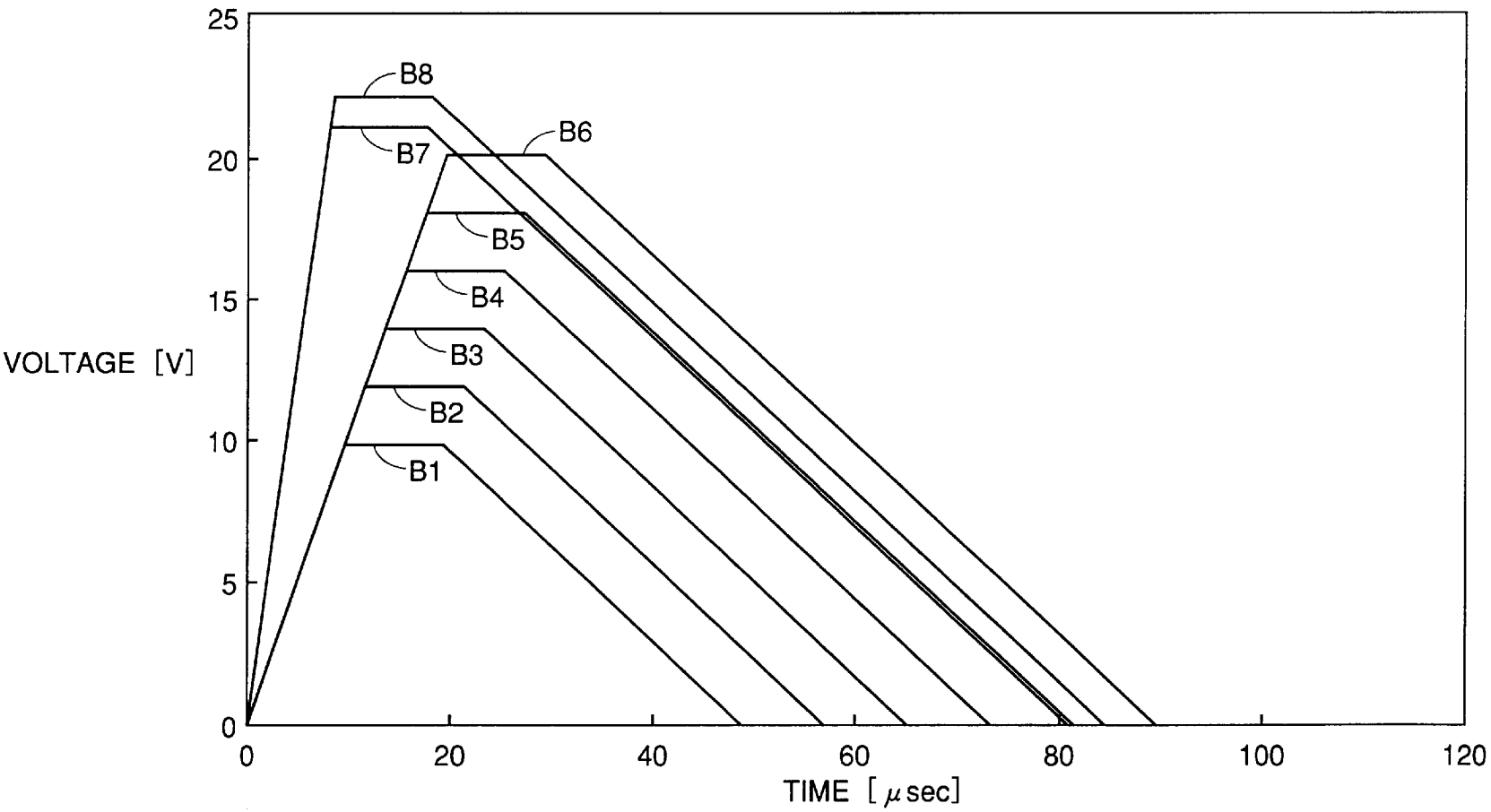
FIG. 12 shows a set of waveforms B1–B8 of pulse voltage applied to a piezoelectric element of an ink jet printer according to a second embodiment of the invention.

The pulse voltage shown by FIGS. 7 and 12 is applied to the piezoelectric element by head emission drive unit 105 based on control by CPU 101.

Figure 17:
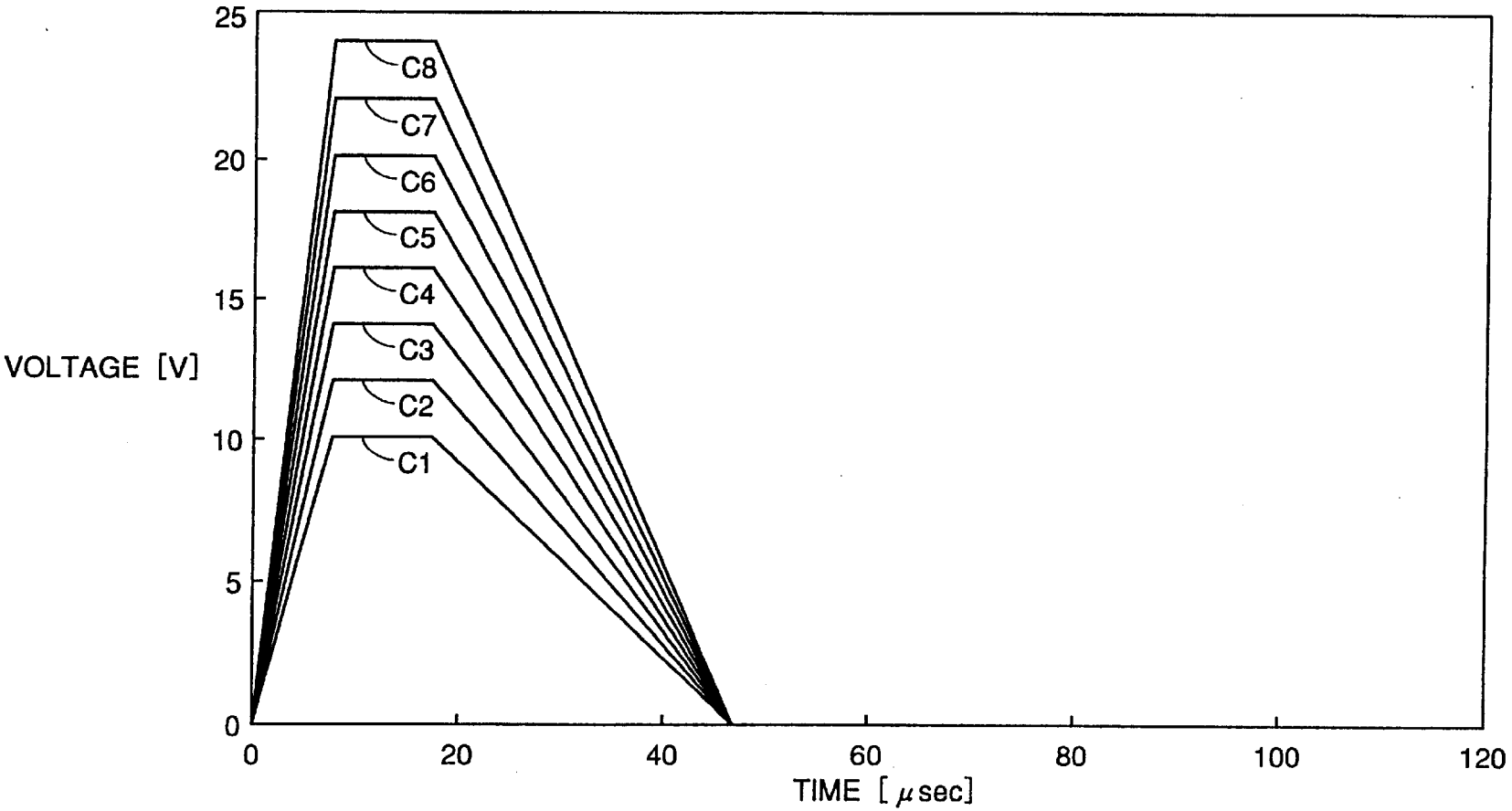
FIG. 17 shows a set of waveforms C1–C8 of pulse voltage applied to a piezoelectric element of a conventional ink jet printer provided as a first example for comparison.
Figure 23:
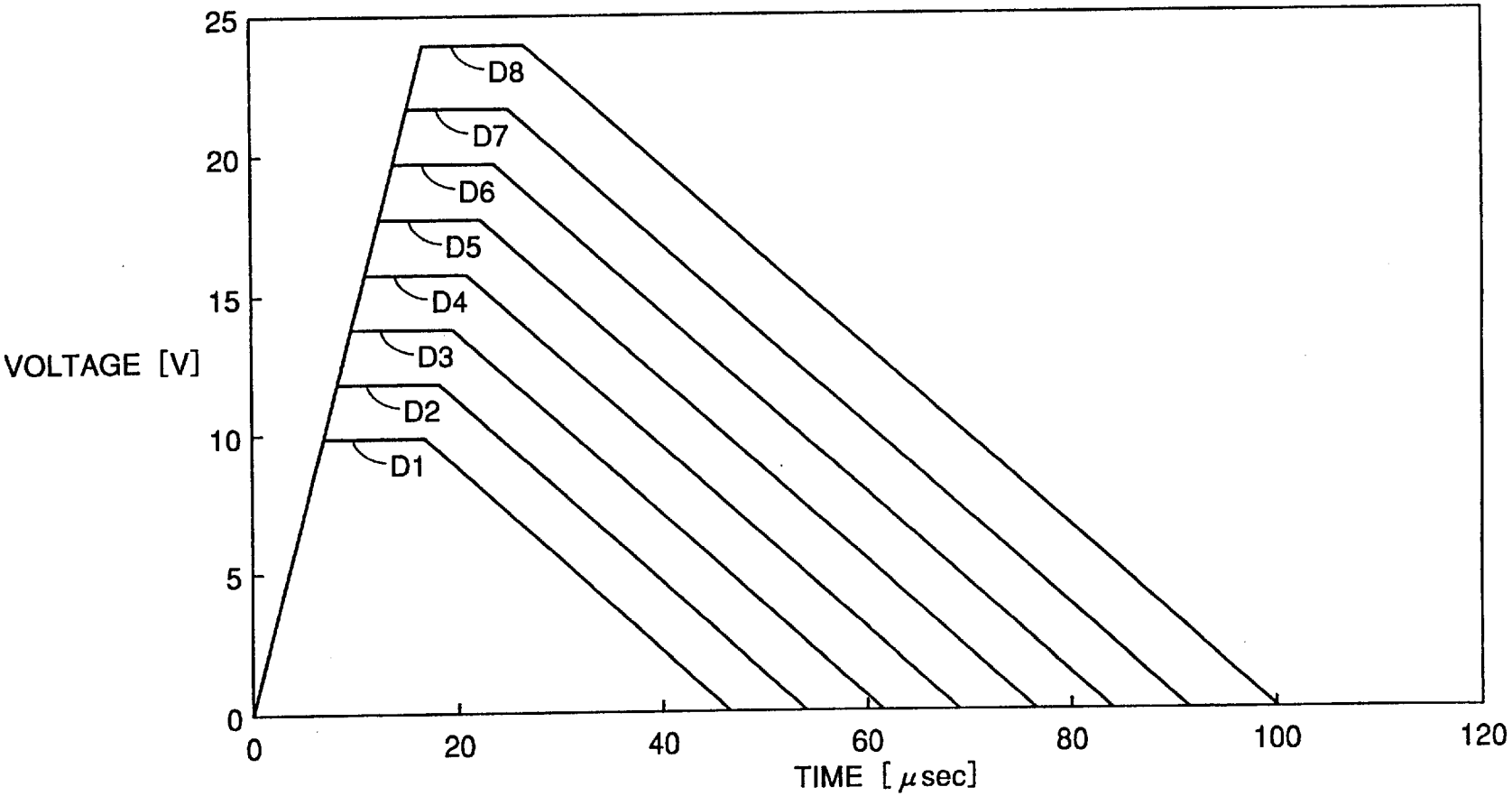
FIG. 23 shows a set of waveforms D1–D8 of pulse voltage applied to a piezoelectric element of a conventional ink jet printer provided as a second example for comparison.
Figure 24:
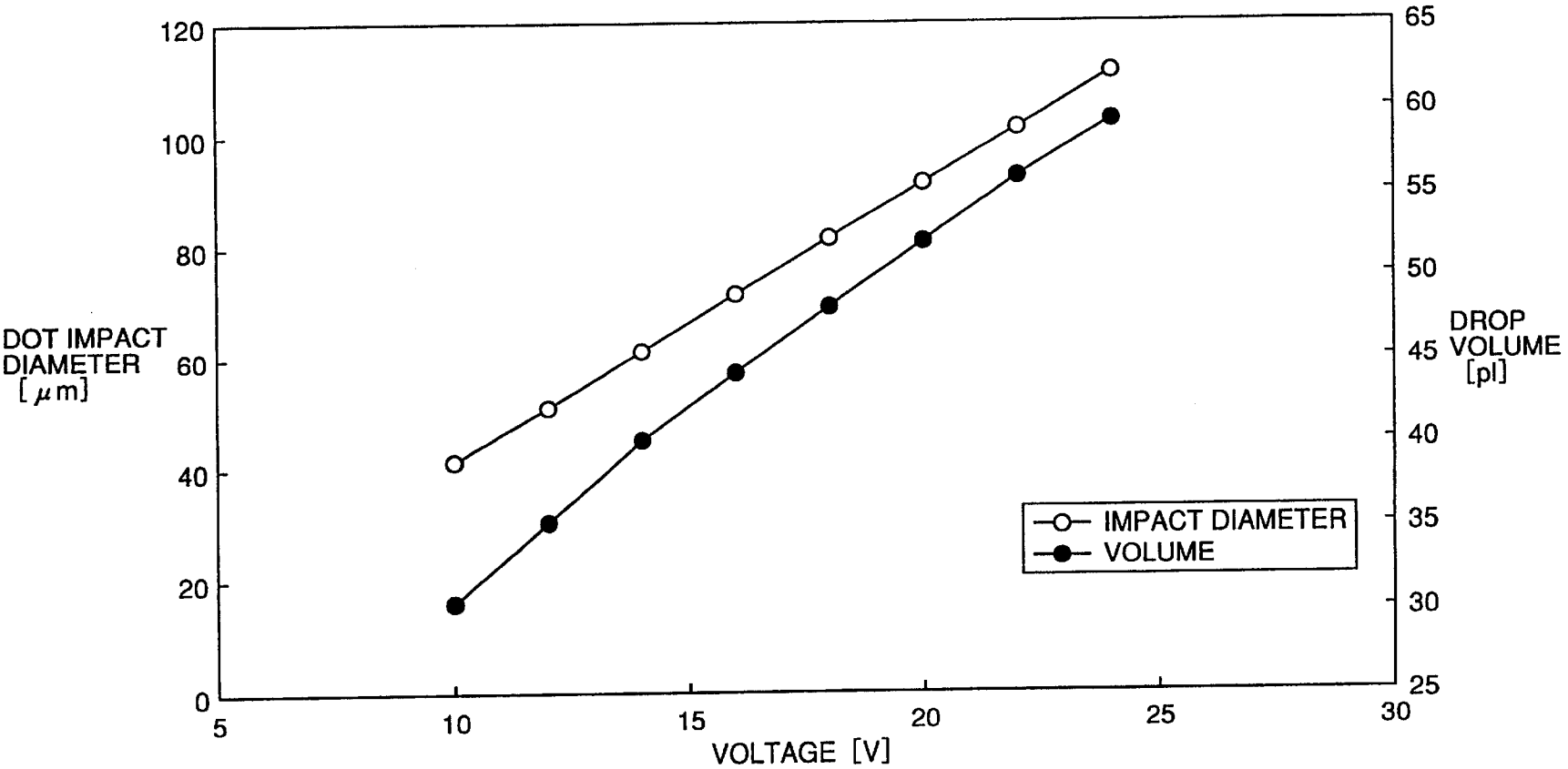
FIG. 24 shows a dot impact diameter of an ink drop flown by pulse voltage having waveforms D1–D8 of FIG. 23 as well as the volume of the ink drop.

FIGS. 7 and 12 respectively show a set of waveforms A (A1–A8) and a set of waveforms B (B1–B8) of pulse voltage applied to a piezoelectric element in a head of an ink jet printer according to an embodiment of the invention. The waveforms A (A1–A8) and B (B1–B8) respectively correspond to ink jet printers according to the first and second embodiments. An entire structure, as well as the structures of a head and a control unit of the ink jet printer of the second embodiment are similar to those of the ink jet printer of the first embodiment. FIGS. 17 and 23 respectively show waveforms C (C1–C8) and D (D1–D8) for conventional ink jet printers respectively provided as the first and second examples for comparison.

As shown in FIGS. 7, 12, 17 and 23 respectively showing the sets of waveforms A (A1–A8) to D (D1–D8), voltage is represented by ordinates, and time passed from the time of start of applying voltage is represented by abscissas. On each coordinate system, the time of stating application of voltage is set at the same time, and numbers of 1–8 are suffixed to alphabet letters of A–D for distinguishing a difference of waveforms, successively from a waveform having the smallest pulse amplitude. As the pulse amplitude is increased, a dot of a larger diameter is printed. By applying different amount of pulse voltages to a piezoelectric element, dots of different sizes are printed to reproduce gradation.

FIG. 7 shows waveforms A1–A8 of pulse voltage applied to a piezoelectric element. A rise rate (an amount of voltage that rises per one second) of each of waveforms A1–A3 is $2.1\times10^6$ [V/sec] and constant, and the rise rate of each of waveforms A4–A8 is $1.0\times10^6$ [V/sec] and constant. Pulse amplitudes of waveforms A1–A8 are respectively 10, 12, 14, 16, 18, 20, 22 and 24 [V] from the smallest one. For these waveforms A1–A8, the rise rate is set at a higher value when an ink drop of a smaller diameter is to be emitted.

FIG. 12 shows waveforms B1–B8 of pulse voltage applied to a piezoelectric element. The rise rate of each of waveforms B1–B6 is $1.0\times10^6$ [V/sec] and constant, and the rise rate of each of waveforms B7 and B8 is $2.5\times10^6$ [V/sec] and constant. Pulse amplitudes of waveforms B1–B8 are respectively 10, 12, 14, 16, 18, 20, 21 and 22 [V] from the smallest one. For these waveforms B1–B8, the rise rate is set at a higher value when an ink drop of a larger diameter is to be emitted.

FIG. 17 shows waveforms C1–C8 of pulse voltage applied to a piezoelectric element. The rise rates of waveforms C1–C8 are different and respectively $1.3\times10^6$, $1.6\times10^6$, $1.8\times10^6$, $2.1\times10^6$, $2.4\times10^6$, $2.6\times10^6$, $2.9\times10^6$, and $3.2\times10^6$ [V/sec] from the one having the smallest amplitude. The pulse amplitudes of waveforms C1–C8 are respectively 10, 12, 14, 16, 18, 20, 22 and 24 [V] from the smallest one similarly to those of waveforms A.

FIG. 23 shows waveforms D1–D8 of pulse voltage applied to a piezoelectric element. The rise rate of each of waveforms D1–D8 is $1.3\times10^6$ [V/sec] and constant. The pulse amplitudes of waveforms D1–D8 are respectively 10, 12, 14, 16, 18, 20, 22 and 24 from the smallest one as those of waveforms A and C.

The volume of an ink drop flown by applying the pulse voltage having waveforms A (A1–A8) to D (D1–D8), flying speed of the ink drop, diameter of a dot produced by the ink drop flown and impacted on a recording sheet (dot impact diameter), degree of circularity of the dot, response frequency, displacement of the ink drop flown and impacted on the sheet (ink drop displacement) obtained by measurement are shown. FIGS. 8–11, 13–16, 18–22 and 24–27 respectively show pulse amplitudes of waveforms A (A1–A8) to D (D1–DB) respectively shown in FIGS. 7, 12, 17 and 23 by abscissas, and show the volume and flying speed of the ink drop, dot impact diameter, degree of circularity, response frequency and ink drop displacement corresponding to those pulse amplitudes by ordinates.

The dot impact diameter is a diameter corresponding to an area, and the response frequency is indicated by the maximum value of driving frequency by which dots of the same size are generated. If the driving frequency equals to the response frequency or less, dots of the same diameter are generated. However, if the driving frequency exceeds the response frequency, the size of dots periodically change since supply of ink is not sufficient. The degree of circularity is obtained by $\frac{1}{4}\pi\times PM^2/A\times100$. Here, PM is a circumference of a dot, A is an area of a dot, and a measuring device used is Luzex 500 (produced by Nileco).

Figure 11:
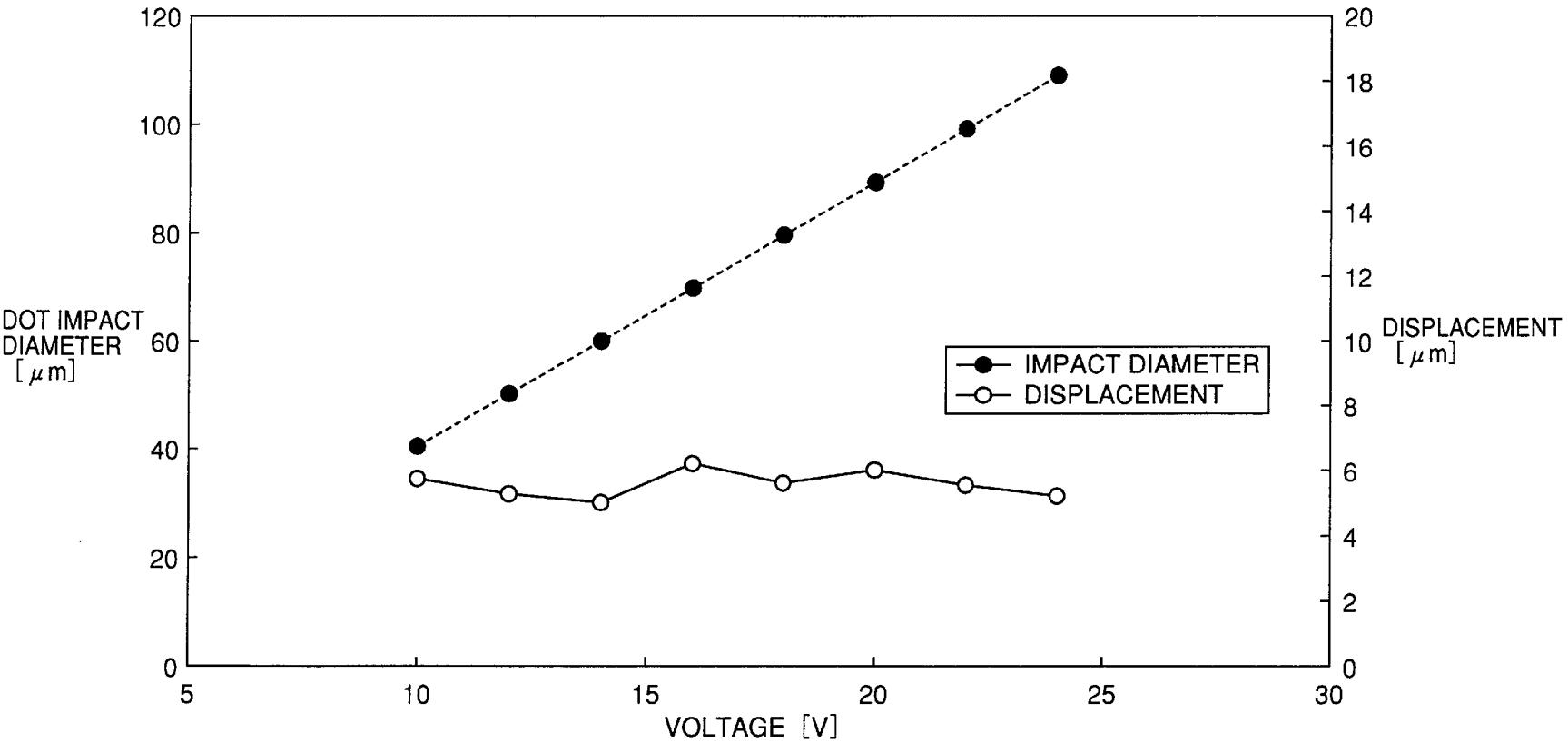
FIG. 11 shows a displacement of an ink drop flown and impacted on a medium (ink drop displacement) by pulse voltage having waveforms A1–A8 shown in FIG. 7.
Figure 22:
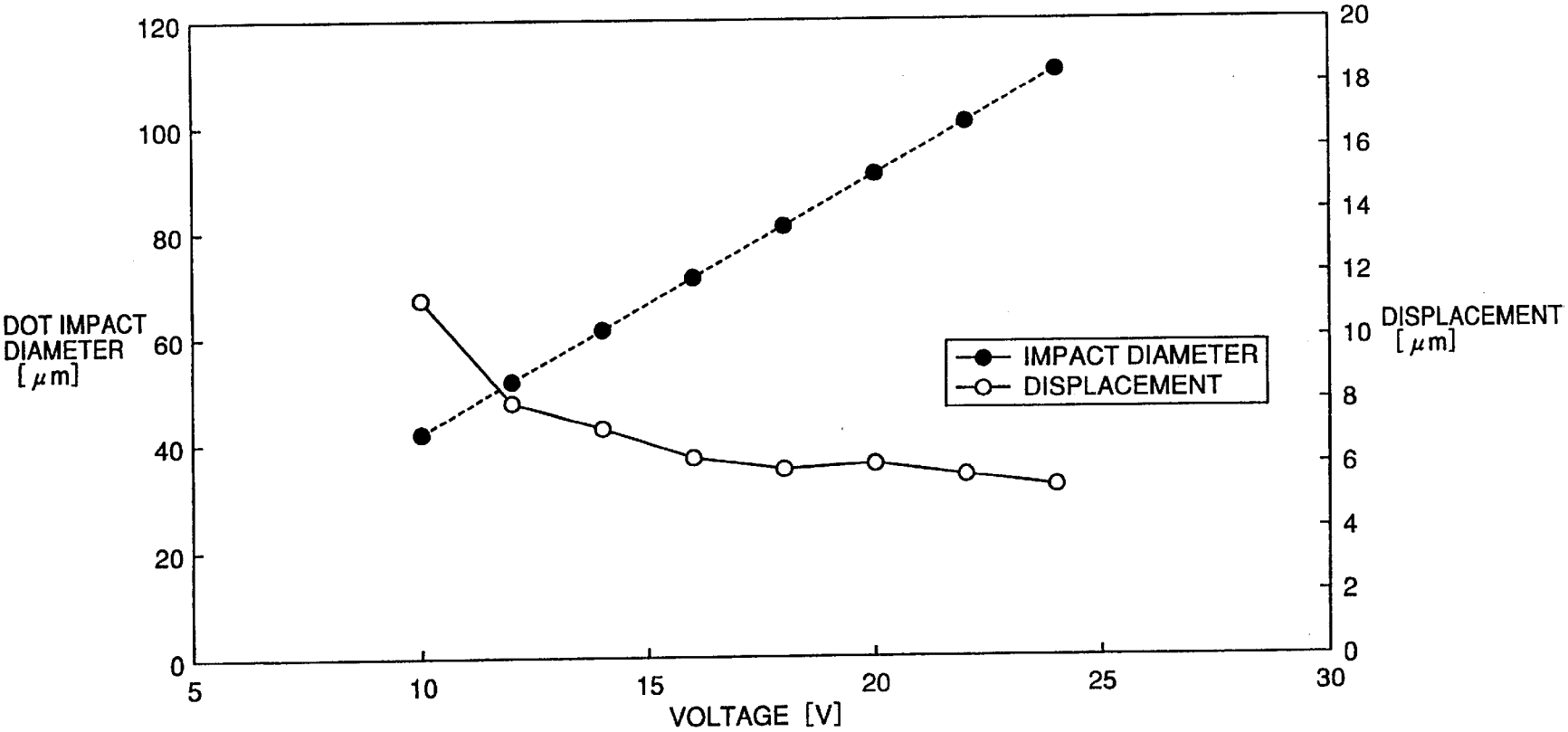
FIG. 22 shows an ink drop displacement of an ink drop flown by pulse voltage having waveforms C1–C8 of FIG. 17.

The ink drop displacement is generated due to the scanning of recording sheet 2 by carriage 4. Specifically, the ink drop displacement is an amount of displacement on the recording sheet from a time of flying of an ink drop from nozzle 307 to a time of impacting thereof on a recording sheet, when the ink drop is flown while the recording sheet 2 is scanned by carriage 4 (see FIG. 1). When the measurement is actually conducted, the scanning speed of the carriage is set at 480 [mm/sec], a marking provided on the sheet is optically read by a sensor placed on the carriage, and the timing of emitting ink is controlled such that an ink drop impacts on a predetermined position. Referring to FIGS. 11 and 22, an absolute value of an amount of deviation from a predetermined position is represented by the ordinates.

Black ink for MJ-500C (produced by Epson) is used as the ink, and LX-jet glossy film (produced by HP) is used as the recording sheet in these measurements.

Figure 9:
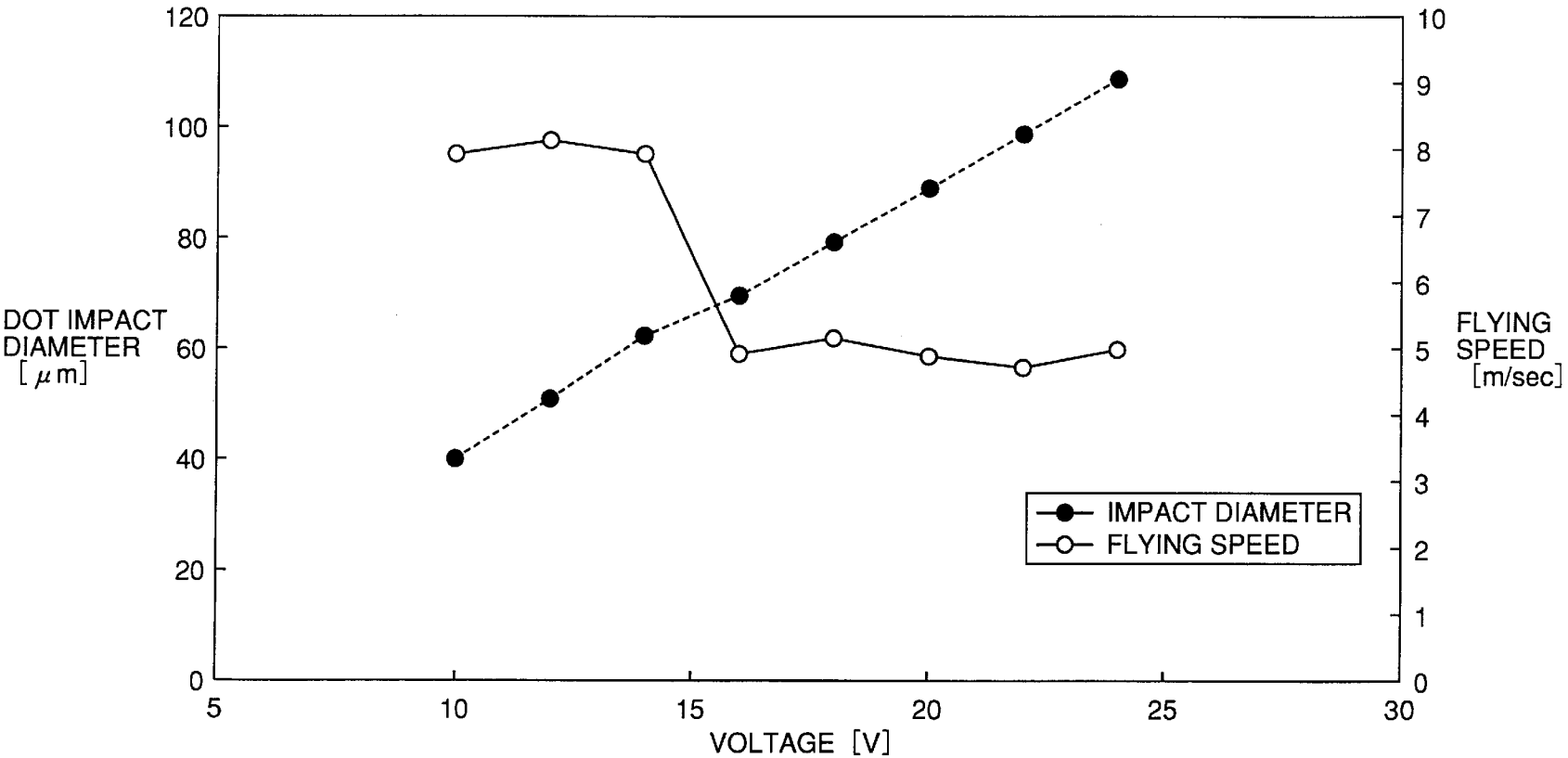
FIG. 9 shows a flying speed of an ink drop flown by pulse voltage having waveforms A1–A8 shown in FIG. 7.
Figure 10:
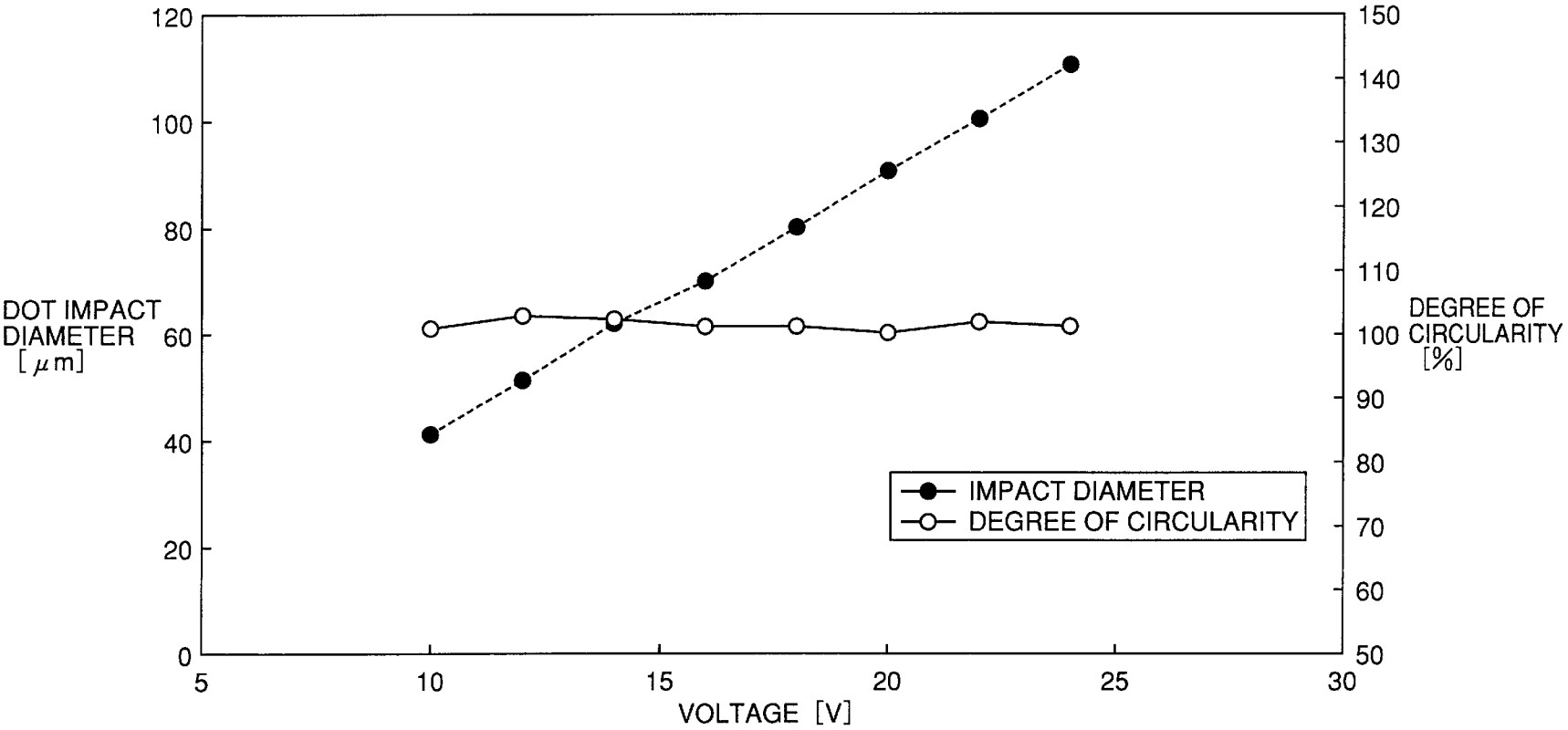
FIG. 10 shows a degree of circularity of an ink drop flown by pulse voltage having waveforms A1–A8 shown in FIG. 7.

FIGS. 8–11 are obtained by driving a piezoelectric element by pulse voltage having waveforms A1–A8 of FIG. 7. FIGS. 8, 9, 10 and 11 respectively show the dot impact diameter and the volume of an ink drop, the flying speed, the degree of circularity, and the ink drop displacement. FIGS. 9–11 also show the dot impact diameter as FIG. 8, and the Table 1 shown below provides data used for obtaining these figures.

TABLE 1

| | Voltage [V] | Dot Impact Diameter [μm] | Volume [pl] | Flying Speed [m/sec] | Degree of Circularity [%] | Ink Drop Displacement [μm] |
|---|---|---|---|---|---|---|
| A1 | 10 | 41 | 30.6 | 8.0 | 101.0 | 5.8 |
| A2 | 12 | 51 | 35.4 | 8.2 | 103.0 | 5.4 |
| A3 | 14 | 62 | 40.1 | 8.0 | 103.0 | 5.1 |
| A4 | 16 | 70 | 43.5 | 5.0 | 102.0 | 6.3 |
| A5 | 18 | 80 | 47.5 | 5.2 | 102.0 | 5.8 |
| A6 | 20 | 90 | 51.3 | 5.0 | 101.0 | 6.1 |
| A7 | 22 | 100 | 55.7 | 4.8 | 102.5 | 5.7 |
| A8 | 24 | 110 | 58.6 | 5.1 | 102.0 | 5.4 |

Figure 13:
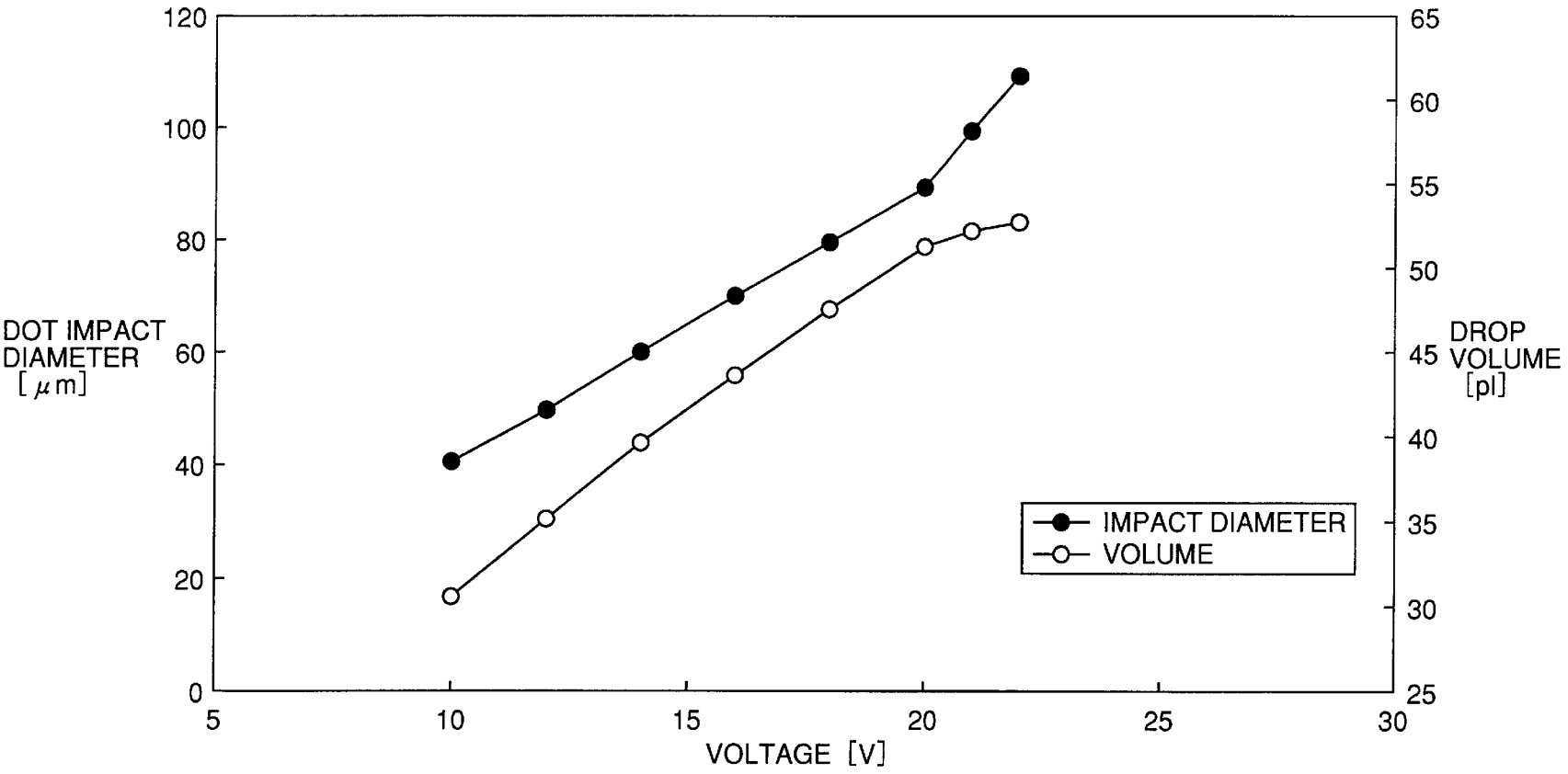
FIG. 13 shows a dot impact diameter generated by an ink drop flown by pulse voltage having waveforms B1–B8 of FIG. 12 as well as the volume of the ink drop.
Figure 14:
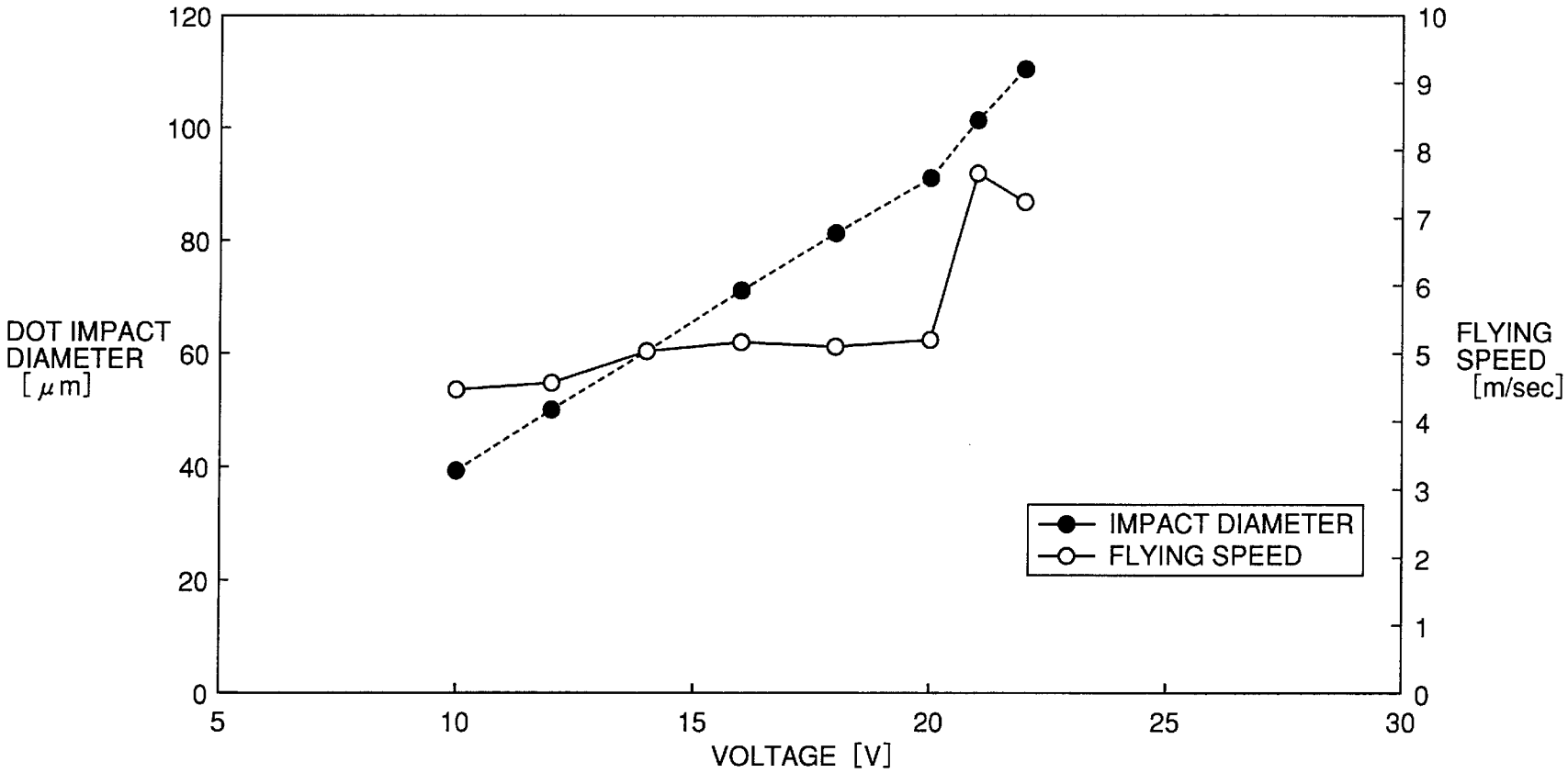
FIG. 14 shows a flying speed of an ink drop flown by pulse voltage having waveforms B1–B8 of FIG. 12.
Figure 15:
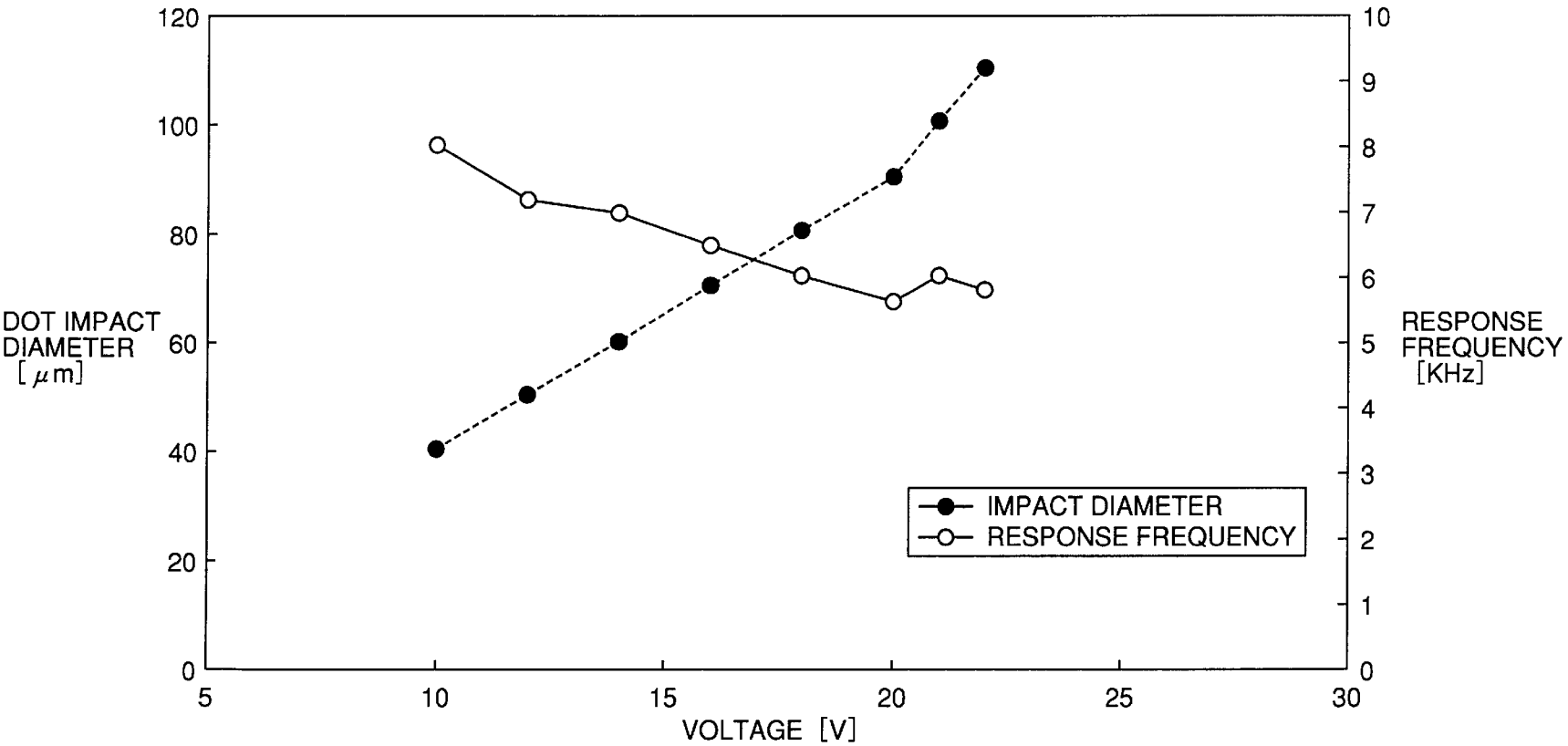
FIG. 15 shows a response frequency for an ink drop flown by pulse voltage having waveforms B1–B8 of FIG. 12.
Figure 16:
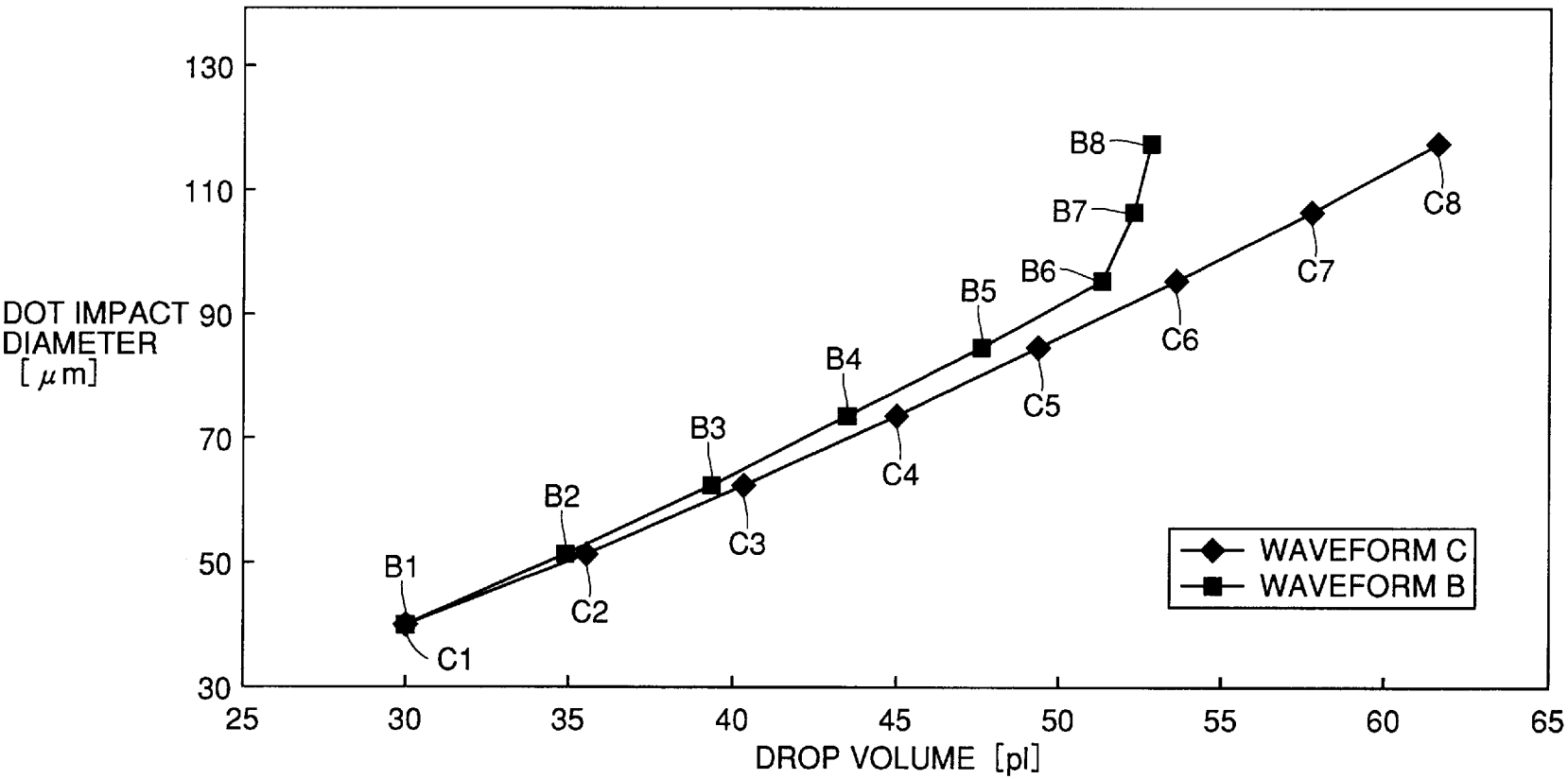
FIG. 16 is provided for comparing a relation between the dot impact diameter and the ink drop volume of an ink drop flown by pulse voltage having waveforms B1–B8 of FIG. 12, with a relation between the dot impact diameter and the ink drop volume of an ink drop flown by pulse voltage having waveforms C1–C8 of FIG. 17.

FIGS. 13–16 are obtained by driving a piezoelectric element by pulse voltage having waveforms B1–B8 shown in FIG. 12. FIG. 13 shows the dot impact diameter and the volume of an ink drop, FIG. 14 shows the flying speed, and FIG. 15 shows the response frequency. FIG. 16 is provided for comparing a difference between a relation of the dot impact diameter and the drop volume for waveforms B1–B8 with a relation of the dot impact diameter and the drop volume for waveforms C1–C8 presented as an example for comparison as described below. FIGS. 14 and 15 also show the dot impact diameter as FIG. 13, and the Table 2 provides data used for obtaining these figures.

TABLE 2

| | Voltage [V] | Dot Impact Diameter [μm] | Volume [pl] | Flying Speed [m/sec] | Response Frequency [kHz] |
|---|---|---|---|---|---|
| B1 | 10 | 40 | 30.2 | 4.5 | 8.0 |
| B2 | 12 | 50 | 34.9 | 4.6 | 7.2 |
| B3 | 14 | 60 | 39.4 | 5.0 | 7.0 |
| B4 | 16 | 70 | 43.6 | 5.1 | 6.5 |
| B5 | 18 | 80 | 47.6 | 5.0 | 6.0 |
| B6 | 20 | 90 | 51.5 | 5.1 | 5.6 |
| B7 | 21 | 100 | 52.4 | 7.6 | 6.0 |
| B8 | 22 | 110 | 52.9 | 7.3 | 5.8 |

Figure 18:
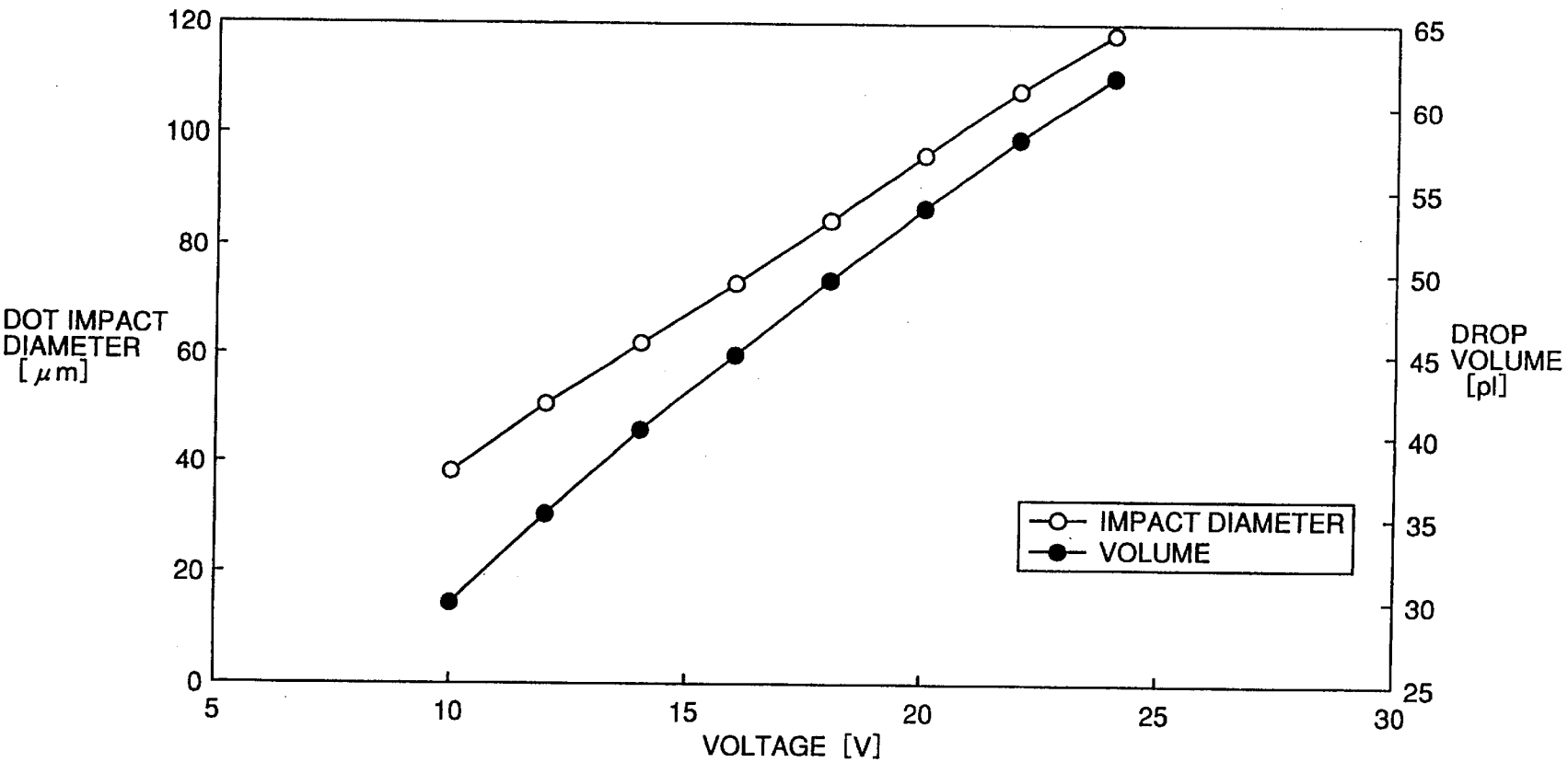
FIG. 18 shows a dot impact diameter of an ink drop flown by pulse voltage having waveforms C1–C8 of FIG. 17 as well as the volume of the ink drop.
Figure 19:
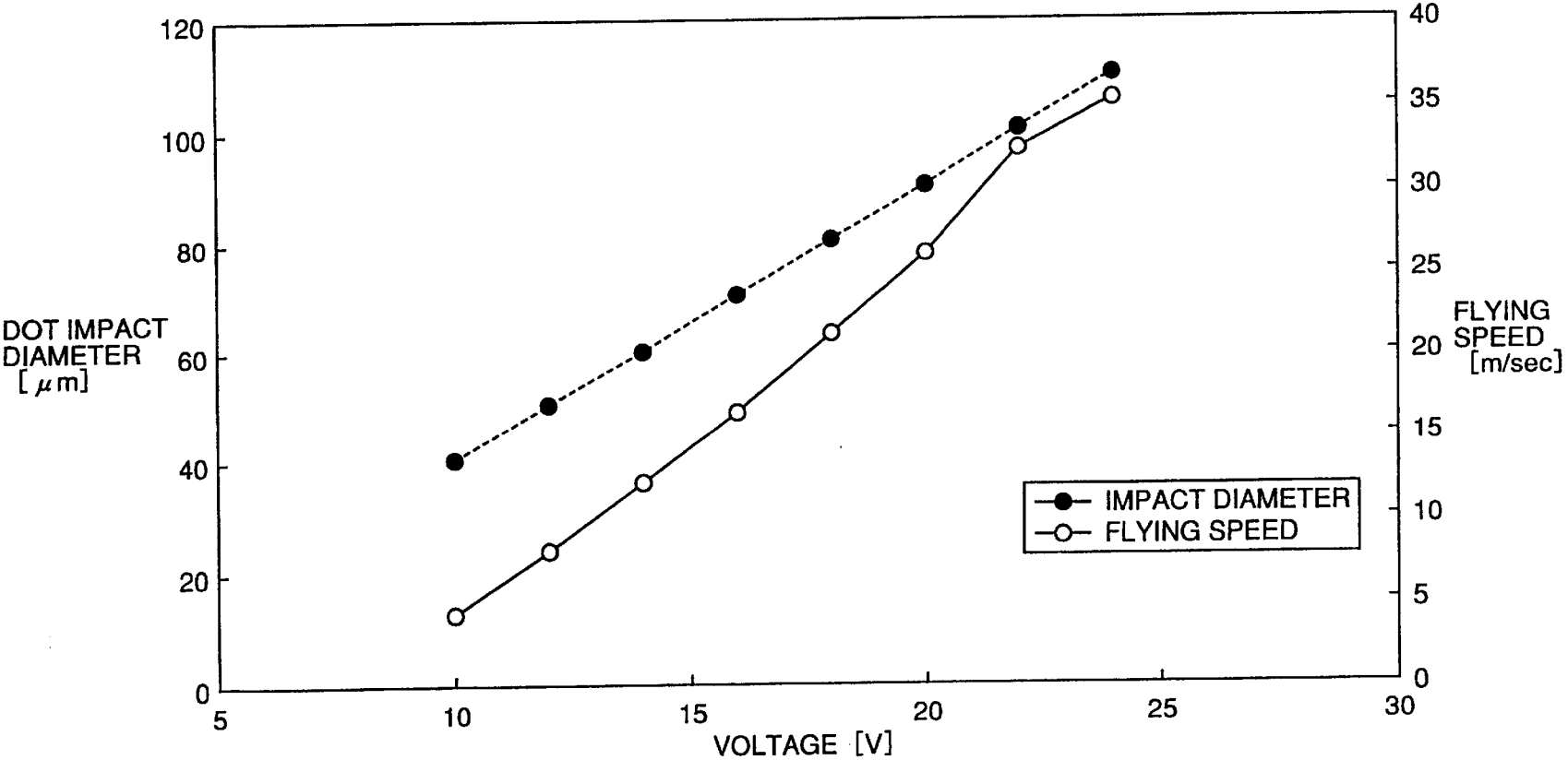
FIG. 19 shows a flying speed of an ink drop flown by pulse voltage having waveforms C1–C8 of FIG. 17.
Figure 20:
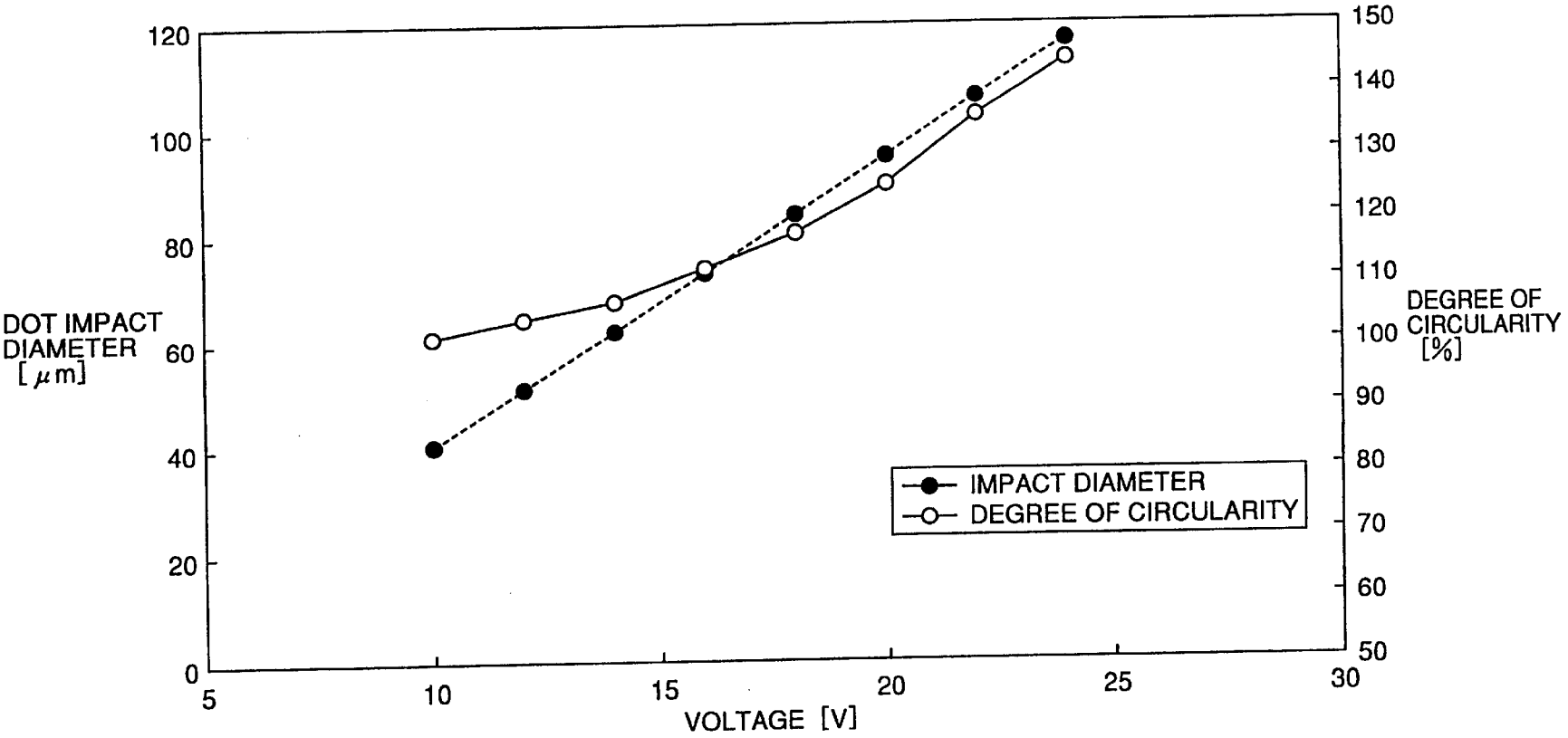
FIG. 20 shows a degree of circularity of an ink drop flown by pulse voltage having waveforms C1–C8 of FIG. 17.
Figure 21:
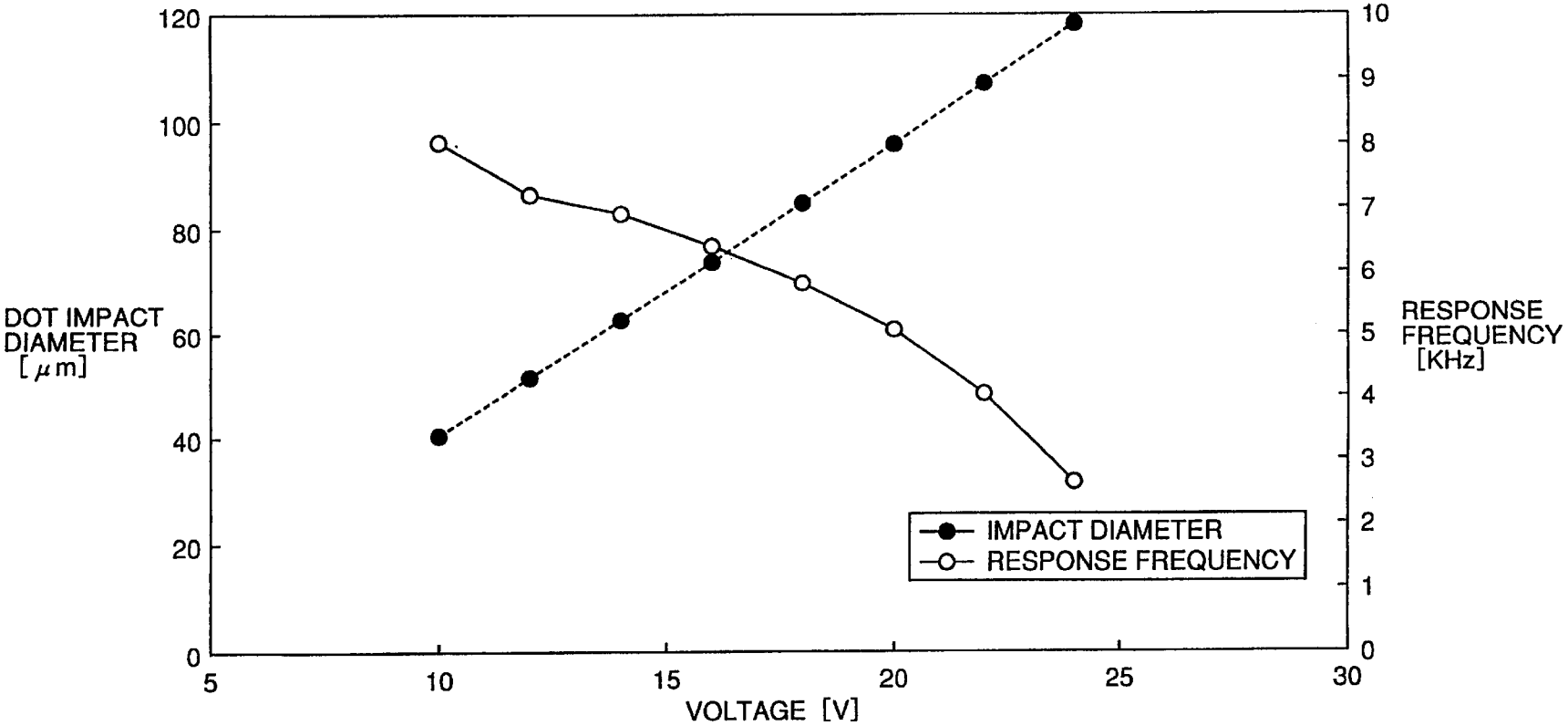
FIG. 21 shows a response frequency for an ink drop flown by pulse voltage having waveforms C1–C8 of FIG. 17.

FIGS. 18–22 are obtained by driving a piezoelectric element by pulse voltage having waveforms C1–C8 shown in FIG. 17 presented as an example for comparison. FIG. 18 shows the dot impact diameter and the drop volume, FIG. 19 shows the flying speed, FIG. 20 shows the degree of circularity, FIG. 21 shows the response frequency, and FIG. 22 shows the ink drop displacement. FIGS. 19–22 also show the dot impact diameter as FIG. 18, and the Table 3 below presents data for obtaining these figures.

Figure 25:
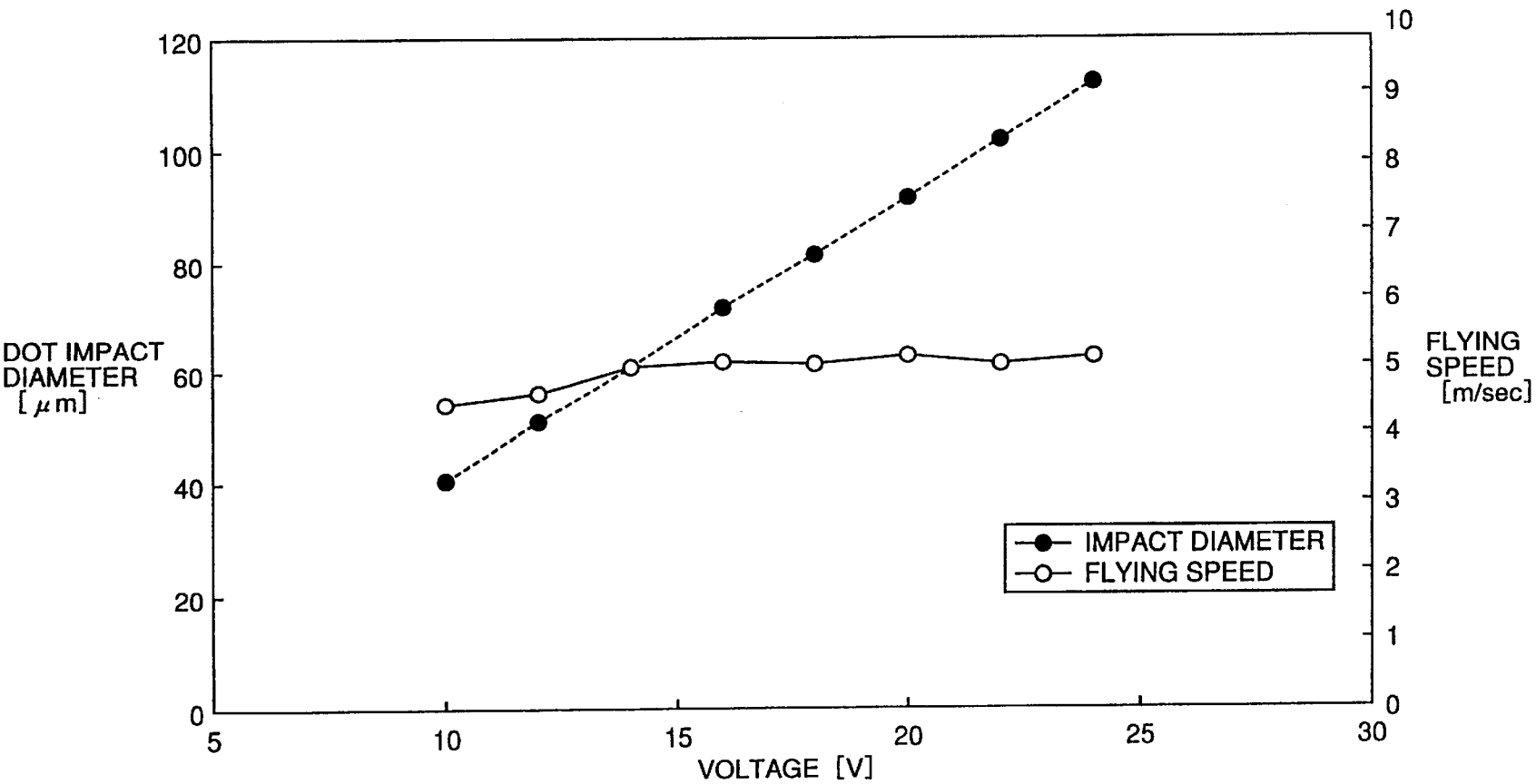
FIG. 25 shows a flying speed of an ink drop flown by pulse voltage having waveforms D1–D8 of FIG. 23.
Figure 26:
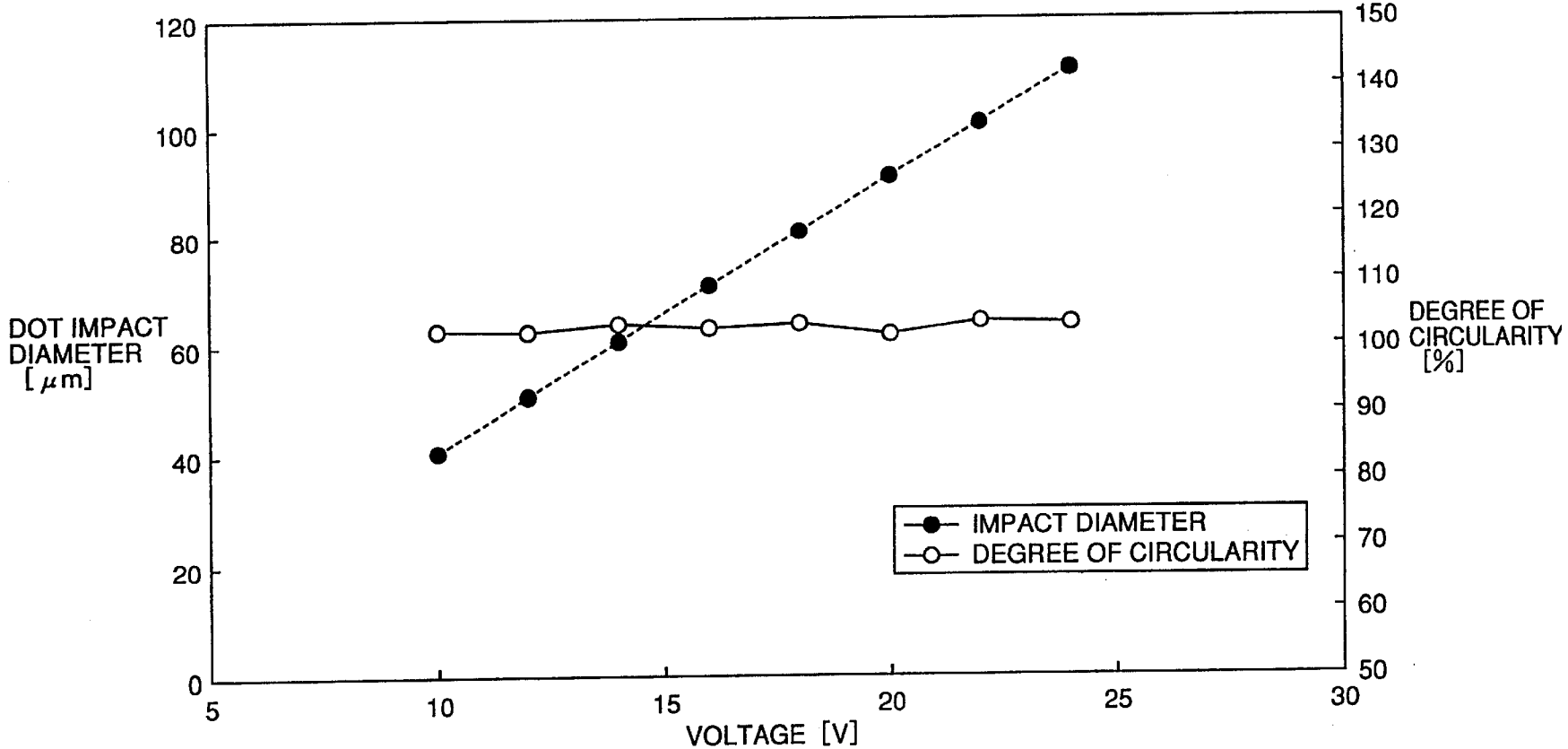
FIG. 26 shows a degree of circularity of an ink drop flown by pulse voltage having waveforms D1–D8 shown in FIG. 23.
Figure 27:
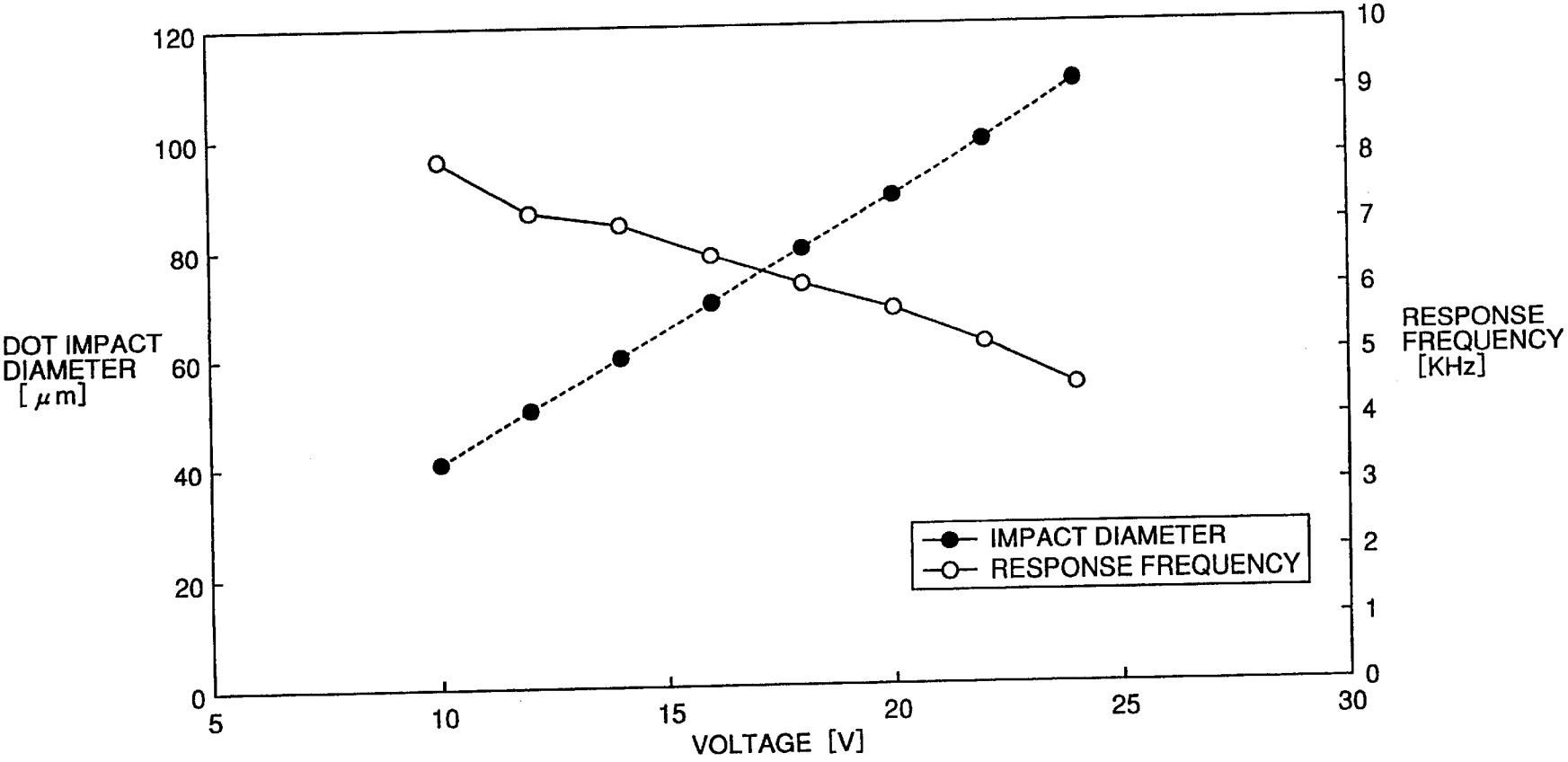
FIG. 27 shows a response frequency for an ink drop flown by pulse voltage having waveforms D1–D8 of FIG. 23.

FIGS. 24–27 are obtained by driving a piezoelectric element by pulse voltage having waveforms D1–D8 shown in FIG. 23 presented as an example for comparison. FIGS. 24, 25, 26 and 27 show the dot impact diameter and the drop volume, the flying speed, the degree of circularity, and the response frequency respectively. FIGS. 25–27 also show the dot impact diameter as FIG. 24, and the Table 4 below presents data used for obtaining these figures.

TABLE 4

| | Voltage [V] | Dot Impact Diameter [μm] | Volume [pl] | Flying Speed [m/sec] | Degree of Circularity [%] | Response Frequency [kHz] |
|---|---|---|---|---|---|---|
| D1 | 10 | 40 | 30.2 | 4.5 | 101.0 | 8.0 |
| D2 | 12 | 50 | 34.9 | 4.6 | 101.3 | 7.2 |
| D3 | 14 | 60 | 39.4 | 5.0 | 102.0 | 7.0 |
| D4 | 16 | 70 | 43.6 | 5.1 | 112.2 | 6.5 |
| D5 | 18 | 80 | 47.6 | 5.0 | 102.0 | 6.0 |
| D6 | 20 | 90 | 51.5 | 5.2 | 101.0 | 5.6 |
| D7 | 22 | 100 | 55.2 | 5.0 | 102.5 | 5.1 |
| D8 | 24 | 110 | 58.8 | 5.1 | 102.0 | 4.6 |

Based on the data provided by FIGS. 8–11, 13–16, 18–22, and 24–27 (Table 1–Table 4), the results of the measurements obtained by waveforms A1–A8 for an ink jet printer according to the first embodiment and by waveforms B1–B8 for an ink jet printer according to the second embodiment are examined by comparing with the results of measurements obtained by waveforms C1–C8 for an ink jet printer as the first example for comparison and by waveforms D1–D8 for an ink jet printer as the second example for comparison.

Results of measurements of the flying speed for waveforms A (A1–A8) to D (D1–D8) are compared with one another. Referring to FIG. 19, the flying speed obtained by waveforms C (C1–C8) ranges from 5 to 35 [m/s] as the dot impact diameter increases. On the other hand, the flying speed obtained by waveforms D (D1–D8) takes an almost constant value of approximately 5 [m/s]. The flying speed obtained by waveforms A1–A8 and B1–B8 ranges from 5 to 8 [m/s]. This range is small compared with that of the flying speed obtained by waveforms C1–C8.

Specifically, the flying speed of an ink drop caused by waveforms A1–A3 each is approximately 8 [m/s] and stable when the ink drop is emitted such that it corresponds to waveforms A1–A3 each and the drop volume is less than 40 [pl]. The flying speed by waveforms A4–A8 each is approximately 5 [m/s] and stable when an ink drop is emitted correspondingly to waveforms A4–A8 each and the drop volume is 40 [pl] or more. (See FIGS. 8 and 9.)

The flying speed of an ink drop caused by waveforms B1–B6 each is approximately 5 [m/s] and stable when the ink drop is emitted correspondingly to waveforms B1–B6

TABLE 3

| | Voltage [V] | Dot Impact Diameter [μm] | Volume [pl] | Flying Speed [m/sec] | Degree of Circularity [%] | Response Frequency [kHz] | Ink Drop Displacement [μm] |
|---|---|---|---|---|---|---|---|
| C1 | 10 | 40 | 30.2 | 4.5 | 101.0 | 8.0 | 11.3 |
| C2 | 12 | 51 | 35.5 | 8.1 | 104.0 | 7.2 | 8.1 |
| C3 | 14 | 62 | 40.4 | 12.0 | 107.0 | 6.9 | 7.2 |
| C4 | 16 | 74 | 45.1 | 16.2 | 112.0 | 6.4 | 6.3 |
| C5 | 18 | 85 | 49.5 | 20.9 | 118.0 | 5.9 | 5.8 |
| C6 | 20 | 96 | 53.7 | 25.8 | 125.0 | 5.2 | 6.1 |
| C7 | 22 | 107 | 57.8 | 32.2 | 136.0 | 4.1 | 5.7 |
| C8 | 24 | 118 | 61.7 | 35.2 | 145.0 | 2.8 | 5.4 |

each and the drop volume is 30.2–51.5 [pl], and the flying speed is approximately 7.5 [m/s] and stable when the ink drop is emitted correspondingly to waveforms B7 and B8 each and the drop volume is 52.4 and 52.9 [pl]. (See FIGS. 13 and 14.)

The difference of the flying speed is due to the difference of the rise rate of pulse voltage having waveforms A (A1–A8) to D (D1–D8), resulting in a difference of the results of measurements as shown below.

The result of measurements of ink drops obtained by waveforms A1–A8 is hereinafter described. The displacement caused by waveforms A1–A8 takes an almost constant and stable value of 6 [$\mu$m], compared with the displacement caused by waveforms C1–C8 ranging from 5 to 12 [$\mu$m]. (See FIGS. 11 and 22.) In the case of waveforms A1–A8, the displacement corresponding to a dot of a smaller diameter is particularly small compared with that caused by waveforms C1–C8. For the waveforms A1–A8, the flying speed corresponding to the dot of the smaller diameter is increased so that an ink drop having a smaller diameter is not easily influenced by (relative) air flow generated by scanning by the carriage. As a result, the difference of the displacement is generated.

The degree of circularity of a dot produced by waveforms A1–A8 ranges from 101 to 103[%], and is extremely stable and desirable compared with that generated by waveforms C1–C8 ranging from 101 to 145[%]. (See FIGS. 10 and 20.)

As heretofore described, a quality of an image can be improved by increasing a dynamic range by applying pulse voltage having waveforms A1–A8 to a piezoelectric element using an ink jet printer according to the first embodiment.

The result of measurements of ink drops obtained by waveforms B1–B8 is described below. Referring to FIG. 16, especially to a relation between the dot impact diameter and the drop volume obtained by ink drops generated by waveforms B6–B8, the dot impact diameter of the same size as that obtained by waveforms C6–C8 is generated by flying ink drops of smaller volume. The reason is that the impact given by the recording sheet to the ink drops is increased since the flying speed corresponding to dots of larger diameters are increased for waveforms B1–B8 compared with waveforms C1–C8.

The response frequency obtained by waveforms B1–B8 gradually decreases from 8 to 6 [kHz] as the dot diameter increases, and provides a desirable result compared with the response frequency by waveforms C1–C8 that greatly decreases from 8 to 3 [kHz]. (See FIGS. 15 and 21.) The reason is that an influence of vibration of the ink within the ink channel immediately after an ink drop of a larger volume flies therefrom is decreased, since the flying speed corresponding to a dot having a larger diameter is increased for waveforms B1–B8 compared with waveforms C1–C8.

The frequency for driving a piezoelectric element can be increased while an image quality is maintained, by applying pulse voltage having waveforms B1–B8 to a piezoelectric element using an ink jet printer according to the second embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet printer, comprising:

a recording head recording an image on a recording medium by applying a pulse voltage having a waveform of a prescribed shape to a piezoelectric element for driving the piezoelectric element and causing ink drops of different sizes to fly; and a voltage controller controlling a rate of rise of the pulse voltage according to a size of an ink drop to be flown, wherein the rate of rise is at a first constant rate for a first range of sizes of the ink drops to be flown and the rate of rise is at a second constant rate for a second range of sizes of the ink drops to be flown.

2. The ink jet printer according to claim 1, wherein an amplitude of said pulse voltage is changed according to the size of said ink drop.

3. The ink jet printer according to claim 1, wherein the first constant rate is higher than the second constant rate and the ink drops of the first range of sizes are smaller than the ink drops of the second range of sizes.

4. The ink jet printer according to claim 1, wherein the first constant rate is higher than the second constant rate and the ink drops of the first range of sizes are larger than the ink drops of the second range of sizes.

5. The ink jet printer according to claim 1, wherein a time required for said pulse voltage from start of rising to reach an upper side of a waveform of said pulse voltage is changed.

6. The ink jet printer according to claim 1, wherein a time required for said pulse voltage from start of rising to reach a maximum value of a waveform of said pulse voltage is changed.

7. An ink jet printer, comprising:

a recording head recording an image on a recording medium by flying an ink drop, and a controller controlling a flying speed of the ink drop to be flown according to gradation of an image to be printed, wherein the flying speed is substantially at a first rate for a first range of gradation levels and the flying speed is substantially at a second rate for a second range of gradation levels.

8. The ink jet printer according to claim 7, wherein said flying speed is changed according to a size of said ink drop to be flown.

9. The ink jet printer according to claim 7, wherein the first constant rate is higher than the second constant rate and the ink drops of the first range of sizes are smaller than the ink drops of the second range of sizes.

10. The ink jet printer according to claim 7, wherein the first constant rate is higher than the second constant rate and the ink drops of the first range of sizes are larger than the ink drops of the second range of sizes.

11. The ink jet printer according to claim 7, wherein pulse voltage is applied to control flying of said ink drop.

12. The ink jet printer according to claim 11, wherein a rate of rise of said pulse voltage is changed for controlling the flying speed of said ink drop.

13. The ink jet printer according to claim 11, wherein a time required for said pulse voltage from start of rising to reach an upper side of a waveform of said pulse voltage is changed.

14. The ink jet printer according to claim 11, wherein a time required for said pulse voltage from start of rising to reach a maximum value of a waveform of said pulse voltage is changed.

15. A method of controlling flying of an ink drop by an ink jet printer recording an image on a recording medium by flying the ink drop, comprising:

determining a size of a dot to be formed; and controlling a flying speed of said ink drop according to said size of the dot determined, wherein the flying speed is substantially at a first rate for a first range of said sizes and the flying speed is substantially at a second rate for a second range of said sizes.

16. The method according to claim 15, wherein said control step includes a step of controlling flying of said ink drop by applying pulse voltage.

17. The method according to claim 16, wherein said control step includes a step of controlling the flying speed of said ink drop by changing a rate of rise of said pulse voltage.

18. The method according to claim 16, wherein said control step includes a step of changing a time required for said pulse voltage from start of rising to reach an upper side of a waveform of said pulse voltage.

19. The method according to claim 16, wherein said control step includes a step of changing a time required for said pulse voltage from start of rising to reach a maximum value of a waveform of said pulse voltage.

* * * * *